US011590776B2

(12) United States Patent
Ueda

(10) Patent No.: US 11,590,776 B2
(45) Date of Patent: Feb. 28, 2023

(54) PRINTING JIG AND PRINTING APPARATUS TO HOLD SUBSTRATES OF DIFFERENT SIZES

(71) Applicant: Roland DG Corporation, Hamamatsu (JP)

(72) Inventor: Naoki Ueda, Hamamatsu (JP)

(73) Assignee: ROLAND DG CORPORATION, Shizuoka (JP)

( * ) Notice: Subject to any disclaimer, the term of this patent is extended or adjusted under 35 U.S.C. 154(b) by 0 days.

(21) Appl. No.: 17/375,170

(22) Filed: Jul. 14, 2021

(65) Prior Publication Data

US 2022/0016908 A1 Jan. 20, 2022

(30) Foreign Application Priority Data

Jul. 15, 2020 (JP) ..... JP2020-121086

(51) Int. Cl.

| | |
|---|---|
| ***B41J 11/00*** | (2006.01) |
| ***B41J 13/10*** | (2006.01) |
| ***B41J 11/06*** | (2006.01) |
| ***B41J 3/407*** | (2006.01) |

(52) U.S. Cl.

CPC ..... *B41J 11/0025* (2013.01); *B41J 3/4078* (2013.01); *B41J 3/40731* (2020.08); *B41J 11/06* (2013.01); *B41J 13/10* (2013.01)

(58) Field of Classification Search

CPC ..... B41J 11/0025; B41J 13/10; B41J 11/06; B41J 3/40731; B41J 3/4078

See application file for complete search history.

(56) References Cited

U.S. PATENT DOCUMENTS

| | | | | |
|---|---|---|---|---|
| 5,205,026 | A | 4/1993 | Sticht | |
| 5,271,490 | A | 12/1993 | Sticht | |
| 2007/0068403 | A1* | 3/2007 | Fresener | B41J 3/40731 101/115 |
| 2008/0238978 | A1 | 10/2008 | Niimi | |
| 2013/0050328 | A1 | 2/2013 | Yanagishita | |
| 2013/0278694 | A1 | 10/2013 | Takeuchi et al. | |
| 2013/0334010 | A1* | 12/2013 | Gerber | B41J 3/407 198/465.1 |

(Continued)

FOREIGN PATENT DOCUMENTS

| | | | |
|---|---|---|---|
| JP | 03-066534 | A | 3/1991 |
| JP | 2008-238781 | A | 10/2008 |

(Continued)

OTHER PUBLICATIONS

Official Communication issued in corresponding European Patent Application No. 21185820.4, dated Dec. 14, 2021.

*Primary Examiner* — Henok D Legesse
(74) *Attorney, Agent, or Firm* — Keating & Bennett, LLP

(57) ABSTRACT

A printing jig includes bases to be fitted to a printing apparatus, a first holder fittable to each of the bases, and a second holder fittable to each of the bases. The first holder is able to hold one or more first substrates. The second holder is able to hold one or more second substrates different in size from the first substrate or substrates. The first holder includes a first fitting portion to be fitted to each of the bases. The second holder includes a second fitting portion to be fitted to each of the bases. Each of the bases is structured such that the first fitting portion and the second fitting portion are both fittable thereto.

16 Claims, 9 Drawing Sheets

(56) References Cited

U.S. PATENT DOCUMENTS

| | | | |
|---|---|---|---|
| 2017/0129262 | A1 | 5/2017 | Mashima |
| 2018/0215171 | A1 | 8/2018 | Schiestl |

FOREIGN PATENT DOCUMENTS

| | | | |
|---|---|---|---|
| JP | 2013-047398 | A | 3/2013 |
| JP | 2013-221228 | A | 10/2013 |
| JP | 2017-087585 | A | 5/2017 |
| JP | 2017-177551 | A | 10/2017 |
| JP | 2017-202679 | A | 11/2017 |
| JP | 2018-529546 | A | 10/2018 |

* cited by examiner

PRINTING JIG AND PRINTING APPARATUS TO HOLD SUBSTRATES OF DIFFERENT SIZES

CROSS REFERENCE TO RELATED APPLICATIONS

This application claims the benefit of priority to Japanese Patent Application No. 2020-121086 filed on Jul. 15, 2020. The entire contents of this application are incorporated herein by reference.

BACKGROUND OF THE INVENTION

1. Field of the Invention

The present invention relates to printing jigs and printing apparatuses.

2. Description of the Related Art

Flatbed printing apparatuses that effect printing on substrates placed on flat beds are known in the related art. For such a flatbed printing apparatus, a jig for positioning of substrates on a flat bed may be used. JP 2017-177551 A, for example, discloses a printing apparatus that includes a pallet (jig) provided with placement holes conforming in shape to substrates; and a mechanism for positioning of the pallet on a flat bed.

Substrates may be of various sizes. Substrate positioning jigs have conventionally been made on the assumption that each jig effects positioning of one type of substrate determined in advance similarly to, for example, the pallet described in JP 2017-177551 A. Such conventional positioning jigs for printing are unfortunately unable to simultaneously and efficiently hold two or more types of substrates different in size.

SUMMARY OF THE INVENTION

Preferred embodiments of the present invention provide printing jigs that are each able to simultaneously and efficiently hold two or more types of substrates different in size. Other preferred embodiments of the present invention provide printing apparatuses each including such a printing jig.

A printing jig disclosed herein includes bases to be fitted to a printing apparatus, a first holder fittable to each of the bases, and a second holder fittable to each of the bases. The first holder is able to hold one or more first substrates. The second holder is able to hold one or more second substrates different in size from the first substrate or substrates. The first holder includes a first fitting portion to be fitted to each of the bases. The second holder includes a second fitting portion to be fitted to each of the bases. Each of the bases is structured such that the first fitting portion and the second fitting portion are both fittable thereto.

The printing jig includes the first holder that is able to hold the first substrate or substrates, and the second holder that is able to hold the second substrate or substrates different in size from the first substrate or substrates. Both of the first holder and the second holder are fittable to each of the bases. Thus, selecting the holder to be fitted to each of the bases enables the printing jig to simultaneously hold the first and second substrates different in size.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
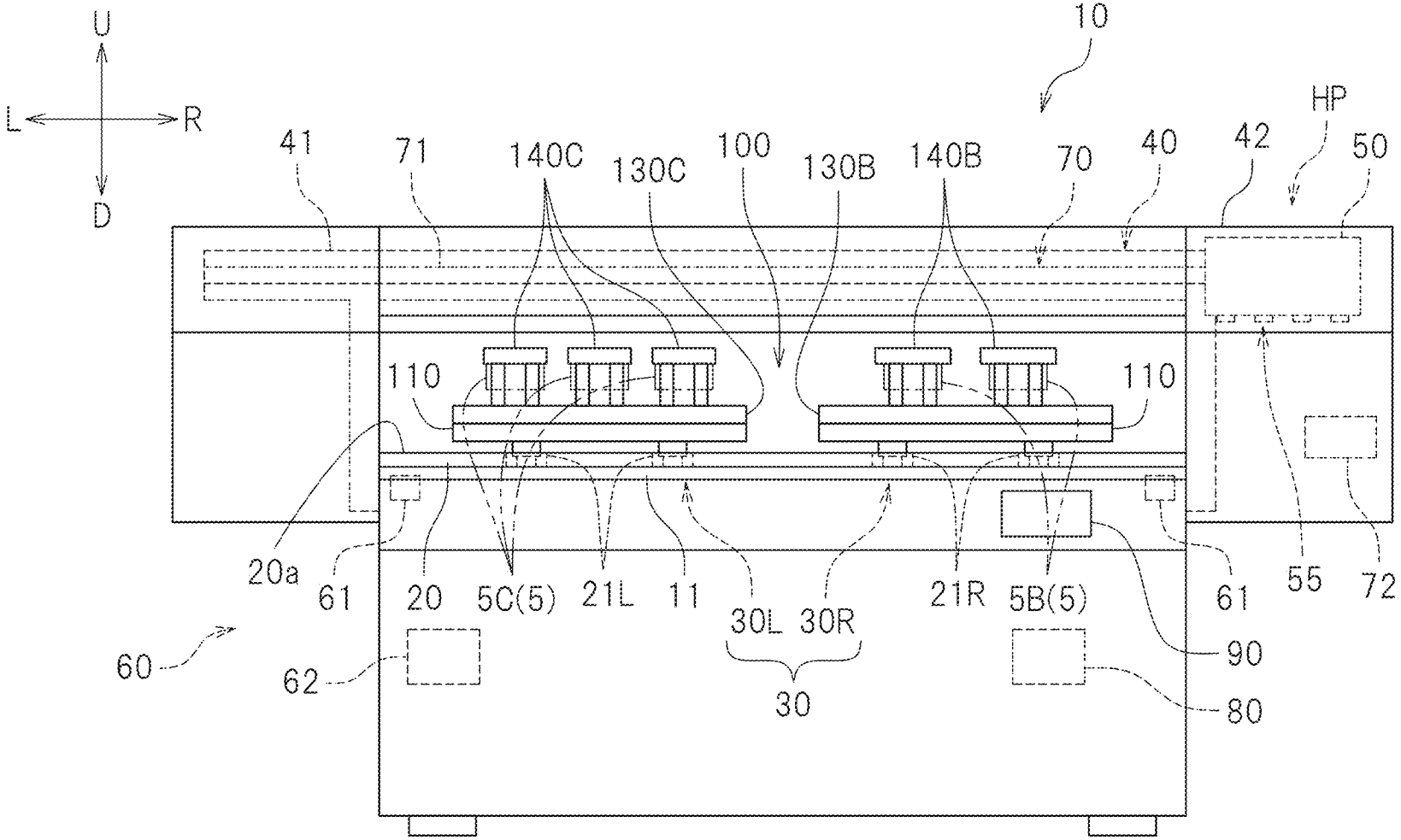
FIG. 1 is a schematic front view of a printer according to a preferred embodiment of the present invention.

Printers according to preferred embodiments of the present invention, including a printer 10, will be described below with reference to the drawings. The preferred embodiments described below are naturally not intended to limit the present invention in any way. Components or elements having the same functions are identified by the same reference signs, and overlapping description thereof will be omitted or simplified as appropriate. The following description is based on the assumption that when a printer 10 is viewed from the front, a direction away from the printer 10 is a forward direction, and a direction toward the printer 10 is a rearward direction. The reference signs F, Rr, L, R, U, and D in the drawings respectively represent front, rear, left, right, up, and down. These directions, however, are defined merely for the sake of convenience of description and do not limit, for example, how the printer 10 may be installed.

Figure 2:
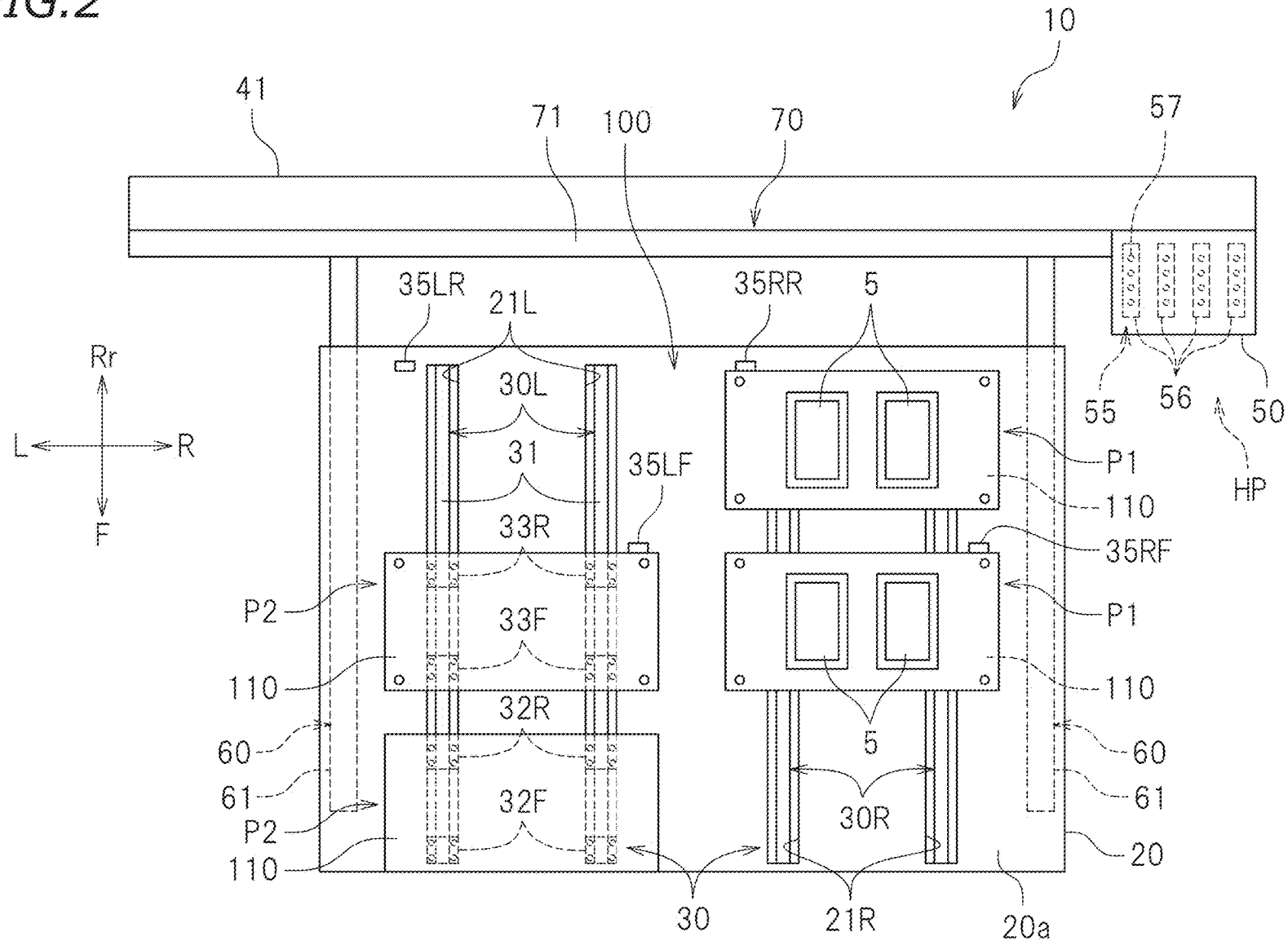
FIG. 2 is a schematic plan view of the printer.

FIG. 1 is a schematic front view of the printer 10 according to the present preferred embodiment. FIG. 2 is a schematic plan view of the printer 10. In FIG. 2, some of components of the printer 10, such as a cover 42 of a printing unit 40, are not illustrated. The printer 10 according to the present preferred embodiment is a large printer that is able to effect printing on a plurality of substrates 5 simultaneously. The printer 10 causes a recording head 55 that moves in a right-left direction and a front-rear direction to discharge ink so as to print images on the substrates 5. The printer 10 according to the present preferred embodiment is a printer that preferably uses an inkjet method. In the present preferred embodiment, the term "inkjet method" refers to any of various inkjet methods known in the related art, including various continuous methods (such as a binary deflection method and a continuous deflection method) and various on-demand methods (such as a thermal method and a piezoelectric method). The method to be used by the printer 10, however, is not limited to the inkjet method.

The substrates 5 are objects on which images are to be printed. The substrates 5 are not limited to any particular materials or products. In this preferred embodiment, the substrates 5 are T-shirts. Alternatively, the substrates 5 may be fabrics other than T-shirts or may be materials or products other than fabrics. Examples of the substrates 5 may include various types of paper, and sheets, such as a resin sheet, a metal sheet, and a rubber sheet. The substrates 5 may be made of any of flexible materials such as those just mentioned or may be objects having regular shapes, such as smartphone cases. The substrates 5 are not limited to any particular type or types or any particular property or properties. As used herein, the term "substrate 5" is a general term for large size (L size) T-shirts, medium size (M size) T-shirts, and small size (S size) T-shirts. The L size T-shirts may hereinafter each be referred to as a "first substrate 5A" (see FIG. 4). The M size T-shirts may hereinafter each be referred to as a "second substrate 5B" (see FIG. 5). The S size T-shirts may hereinafter each be referred to as a "third substrate 5C" (see FIG. 6). The first, second, and third substrates 5A, 5B, and 5C are different in size. In this preferred embodiment, the second substrates 5B are smaller in size than the first substrates 5A, and the third substrates 5C are smaller in size than the second substrates 5B.

As illustrated in FIG. 1, the printer 10 includes a platen 20, a sliding mechanism 30, the printing unit 40, a controller 80, and a printing jig 100 to hold the substrates 5. The sliding mechanism 30 is provided on the platen 20. The sliding mechanism 30 supports the printing jig 100 such that the printing jig 100 is movable in the front-rear direction. The printing unit 40 includes: a carriage 50; the recording head 55 mounted on the carriage 50; a sub-scanning direction mover 60 to move the carriage 50 in the front-rear direction; and a main scanning direction mover 70 to move the carriage 50 in the right-left direction. In the present preferred embodiment, the right-left direction corresponds to a main scanning direction of the printer 10, and the front-rear direction corresponds to a sub-scanning direction of the printer 10.

Figure 3:
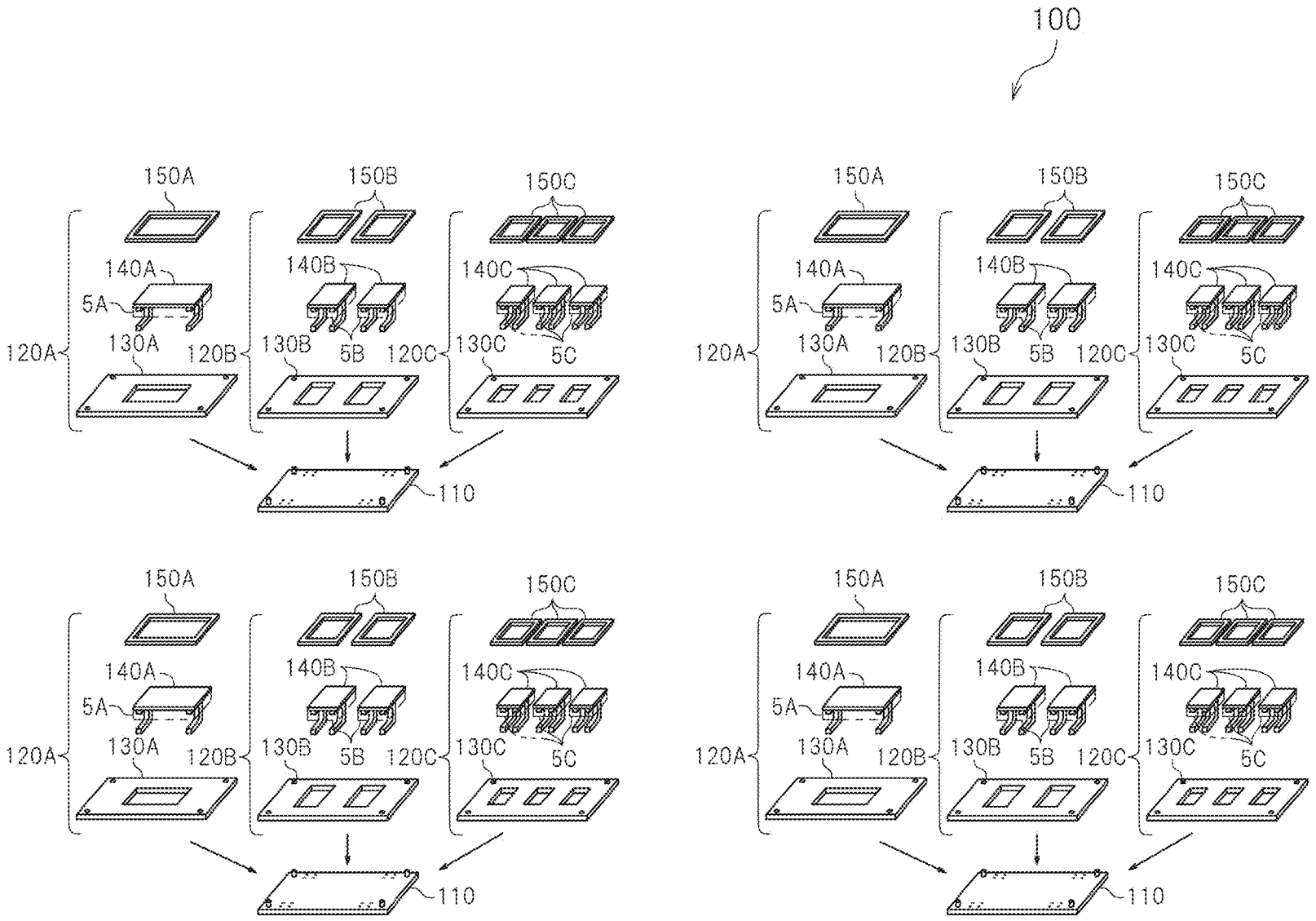
FIG. 3 is a schematic diagram illustrating components of a printing jig.

The printing jig 100 holds the substrates 5 so as to effect positioning of the substrates 5. FIG. 3 is a schematic diagram illustrating components of the printing jig 100. As illustrated in FIG. 3, the printing jig 100 includes: base plates 110; first holding units 120A each configured to be able to hold an associated one of the first substrates 5A; second holding units 120B each configured to be able to hold associated ones of the second substrates 5B; and third holding units 120C each configured to be able to hold associated ones of the third substrates 5C. As illustrated in FIG. 1, the base plates 110 are fitted to the printer 10. The first, second, and third holding units 120A, 120B, and 120C are each fittable to an associated one of the base plates 110. As illustrated in FIG. 3, the first, second, and third holding units 120A, 120B, and 120C are each dividable into sub-components. The printing jig 100 will be described in more detail after the description of the structure of the printer 10.

The platen 20 is a support table for the substrates 5. As illustrated in FIG. 2, the platen 20 has a flat plate shape and extends in the front-rear direction and the right-left direction. As illustrated in FIG. 2, the platen 20 in the present preferred embodiment has a substantially rectangular shape in which its length in the right-left direction is longer than its length in the front-rear direction in a plan view. The right-left direction corresponds to the longitudinal direction of the platen 20. The front-rear direction corresponds to the width direction of the platen 20. As used herein, the term "width direction" refers to a direction in which a shorter side of the printer 10 extends. The platen 20, however, may have a substantially rectangular shape in which its length in the front-rear direction is longer than its length in the right-left direction in the plan view. Alternatively, the platen 20 may have a substantially square shape in which its length in the right-left direction is equal to its length in the front-rear direction. The platen 20 is placed on a platen support 11 having a flat plate shape and thus supported by the platen support 11.

As illustrated in FIG. 2, the platen 20 is provided with a pair of first guide holes 21L and a pair of second guide holes 21R. The pair of first guide holes 21L and the pair of second guide holes 21R pass through the platen 20 in an up-down direction. The pair of first guide holes 21L and the pair of second guide holes 21R are flat long holes extending in the front-rear direction. The pair of first guide holes 21L is disposed leftward of the center of the platen 20. The pair of second guide holes 21R is disposed rightward of the center of the platen 20.

The base plates 110 of the printing jig 100 are fitted to the sliding mechanism 30. The sliding mechanism 30 supports the base plates 110 such that the base plates 110 are movable in the front-rear direction above the platen 20. As illustrated in FIG. 2, the sliding mechanism 30 includes a first sliding mechanism 30L and a second sliding mechanism 30R disposed side by side in the right-left direction. The first sliding mechanism 30L is provided on the platen support 11 such that major portions of the first sliding mechanism 30L except upper portions thereof are housed in the first guide holes 21L of the platen 20. The second sliding mechanism 30R is provided on the platen support 11 such that major portions of the second sliding mechanism 30R except upper portions thereof are housed in the second guide holes 21R of the platen 20. The first and second sliding mechanisms 30L and 30R, however, do not necessarily have to be provided such that portions of the first and second sliding mechanisms 30L and 30R sink below an upper surface 20*a* of the platen 20. In one example, the first and second sliding mechanisms 30L and 30R may be provided on the upper surface 20*a* of the platen 20.

In this preferred embodiment, the first sliding mechanism 30L includes a pair of linear-motion guides. As illustrated in FIG. 2, the first sliding mechanism 30L includes a pair of guide rails 31, and four pairs of linear-motion blocks 32F, 32R, 33F, and 33R in slidable engagement with the pair of guide rails 31. In FIG. 2, components of the printing jig 100 located on and above the two left base plates 110 supported by the first sliding mechanism 30L are not illustrated. The upper surfaces of the four pairs of linear-motion blocks 32F, 32R, 33F, and 33R are located above the upper surface 20*a* of the platen 20.

As illustrated in FIG. 2, the first sliding mechanism 30L supports two of the base plates 110 disposed in alignment with each other in the front-rear direction. The pair of linear-motion blocks 32F is in engagement with the pair of guide rails 31 and supports the front end of a front one of the front base plates 110. The pair of linear-motion blocks 32R is in engagement with the pair of guide rails 31 at locations rearward of the pair of linear-motion blocks 32F. The pair of linear-motion blocks 32R supports the rear end of the front one of the base plates 110. The pair of linear-motion blocks 33F is in engagement with the pair of guide rails 31 at locations rearward of the pair of linear-motion blocks 32R. The pair of linear-motion blocks 33F supports the front end of a rear one of the base plates 110. The pair of linear-motion blocks 33R is in engagement with the pair of guide rails 31 at locations rearward of the pair of linear-motion blocks 33F. The pair of linear-motion blocks 33R supports the rear end of the rear one of the base plates 110.

The second sliding mechanism 30R is similar in configuration to the first sliding mechanism 30L. The second sliding mechanism 30R supports the other two base plates 110 disposed in alignment with each other in the front-rear direction. As a result, the four base plates 110 are supported by the sliding mechanism 30. Two of the four base plates 110 are fitted to the first sliding mechanism 30L so as to be in alignment with each other in the front-rear direction. The other two of the four base plates 110 are fitted to the second sliding mechanism 30R so as to be in alignment with each other in the front-rear direction. In other words, a first group of the base plates 110 fitted to the sliding mechanism 30 so as to be side by side in the right-left direction and a second group of the base plates 110 fitted to the sliding mechanism 30 so as to be side by side in the right-left direction are disposed in alignment with each other in the front-rear direction. The sliding mechanism 30 supports the base plates 110 such that each of the base plates 110 is independently movable in the front-rear direction. As will be discussed below in the description of variations, the number of base plates 110 is not limited to the number mentioned above, and the locations of the base plates 110 are not limited to the locations described above.

The printer 10 further includes stoppers each provided in an associated one of movement paths for the base plates 110. As illustrated in FIG. 2, the stoppers include a left front stopper 35LF, a left rear stopper 35LR, a right front stopper 35RF, and a right rear stopper 35RR. The stoppers 35LF, 35LR, 35RF, and 35RR each effect positioning of an associated one of the base plates 110 at a printing position P1 by being brought into abutment with the associated base plate 110. The printing position P1 is a predetermined position of each of the base plates 110 during printing. FIG. 2 illustrates a state where the two right base plates 110 supported by the second sliding mechanism 30R are located at the printing positions P1.

The rear stoppers 35LR and 35RR are respectively disposed rearward of the front stoppers 35LF and 35RF. The positions of the two rear stoppers 35LR and 35RR in the right-left direction are respectively out of alignment with the positions of the two front stoppers 35LF and 35RF in the right-left direction. The left rear base plate 110 and the right rear base plate 110 are respectively brought into abutment with the rear stoppers 35LR and 35RR and thus positioned at the printing positions P1. The left rear base plate 110 includes a protrusion that comes into abutment with the rear stopper 35LR but does not come into abutment with the front stopper 35LF. The right rear base plate 110 includes a protrusion that comes into abutment with the rear stopper 35RR but does not come into abutment with the front stopper 35RF. The left front base plate 110 and the right front base plate 110 are respectively brought into abutment with the front stoppers 35LF and 35RF and thus positioned at the printing positions P1. The left front base plate 110 includes a protrusion that comes into abutment with the front stopper 35LF. The right front base plate 110 includes a protrusion that comes into abutment with the front stopper 35RF.

The sliding mechanism 30 supports the base plates 110 such that each base plate 110 is movable between the printing position P1 of each base plate 110 and a setting position P2 located forward of the printing position P1. In this preferred embodiment, the setting position P2 of each base plate 110 is the foremost position within the movable range of each base plate 110 as illustrated in FIG. 2. FIG. 2 illustrates a state where the two left base plates 110 supported by the first sliding mechanism 30L are located at the setting positions P2. When the two front base plates 110 are positioned at the setting positions P2, the positions of the front ends of the two front base plates 110 in the front-rear direction correspond or substantially correspond to the position of the front end of the platen 20. The sliding mechanism 30 is simply required to support the base plates 110 such that each base plate 110 is movable at least between the printing position P1 and the setting position P2. The setting position P2 of each base plate 110 is not limited to the foremost position within the movable range of each base plate 110. The printing position P1 of each base plate 110 is not limited to the rearmost position within the movable range of each base plate 110.

As illustrated in FIG. 1, the printing unit 40 includes a portal gantry 41 in engagement with the carriage 50. The sub-scanning direction mover 60 moves the gantry 41 in the front-rear direction so as to move the carriage 50 and the recording head 55 in the front-rear direction. As illustrated in FIGS. 1 and 2, the sub-scanning direction mover 60 includes a pair of guide rails and a feed motor 62. The sub-scanning direction mover 60 further includes a belt (not illustrated) and a pair of pulleys (not illustrated). The pair of guide rails 61 extends in the front-rear direction. The gantry 41 is in slidable engagement with the pair of guide rails 61. The belt (not illustrated) is secured to the gantry 41. The belt is an endless belt. The belt is wound around the pair of pulleys (not illustrated) provided on the front and rear of the guide rails 61. The feed motor 62 is attached to one of the pulleys. The feed motor 62 is electrically connected to the controller 80 and thus controlled by the controller 80. Driving the feed motor 62 rotates the pulleys, causing the belt to run. This moves the gantry 41 in the front-rear direction along the guide rails 61.

In the present preferred embodiment, the sub-scanning direction mover 60 is configured or programmed to move the recording head 55 in the front-rear direction. Alternatively, the sub-scanning direction mover 60 may be configured to move the platen 20 or both of the recording head 55 and the platen 20 in the front-rear direction. The sub-scanning direction mover 60 is simply required to be configured to move the recording head 55 in the front-rear direction with respect to the platen 20 by moving at least one of the platen 20 and the recording head 55. When the recording head 55 has a sufficiently long length in the front-rear direction, the recording head 55 does not have to move in the front-rear direction with respect to the platen 20 during printing.

As illustrated in FIG. 1, the main scanning direction mover 70 includes a guide rail 71, a scanning motor 72, a belt (not illustrated), and a pair of pulleys (not illustrated). The guide rail 71 is provided on a horizontal portion of the gantry 41 and extends in the right-left direction. The carriage 50 is in slidable engagement with the guide rail 71. The belt (not illustrated) is secured to the carriage 50. The belt is an endless belt. The belt is wound around the pair of pulleys (not illustrated) provided on the right and left of the guide rail 71. The scanning motor 72 is attached to one of the pulleys. The scanning motor 72 is electrically connected to the controller 80 and thus controlled by the controller 80. Driving the scanning motor 72 rotates the pulleys, causing the belt to run. This moves the carriage 50 in the right-left direction along the guide rail 71.

The printer 10 according to the present preferred embodiment preferably uses a shuttle head method that involves reciprocating the carriage 50 in the right-left direction so as to perform printing. Alternatively, the printer 10 may use a line head method that does not involve moving the carriage 50 in the right-left direction.

During printing standby, the carriage 50 of the printing unit 40 is positioned at the rear end of its movable range in the front-rear direction along the guide rails 61 as illustrated in FIG. 2. During printing standby, the carriage 50 is positioned at the right end of its movable range in the right-left direction along the guide rail 71 and housed in the cover 42 (see FIG. 1). The position of the carriage 50 in this state will hereinafter be referred to as a "home position HP". When the carriage 50 is positioned at the home position HP, the position of the carriage 50 is out of alignment with the setting positions P2 in the front-rear direction. Thus, a space above the setting positions P2 is an open space during printing standby. The home position HP of the carriage 50, however, is not limited to the position described above.

The carriage 50 is provided with the recording head 55. The recording head 55 is provided above the platen 20. As illustrated in FIG. 2, the recording head 55 includes ink heads 56 to discharge ink downward. The ink heads 56 are disposed in alignment with each other in the right-left direction on the carriage 50. The lower surfaces of the ink heads 56 are each provided with nozzles 57 from which ink is to be discharged. The nozzles 57 of each ink head 56 are aligned in the front-rear direction so as to form a nozzle row.

A distance between the lower surface of the recording head 55 and the upper surface 20*a* of the platen 20 is enough to allow the printing jig 100 holding the substrates 5 to pass therebetween. In the present preferred embodiment, a height at which the printing jig 100 holds the substrates 5 is set at a suitable height. Thus, a gap between the surface of each substrate 5 and the recording head 55 is set at a distance suitable for printing.

The controller 80 is housed in a space below the platen 20. The controller 80 is electrically connected to the recording head 55, the feed motor 62, and the scanning motor 72. The controller 80 is configured or programmed to be able to control the recording head 55, the feed motor 62, and the scanning motor 72. The controller 80 is not limited to any particular configuration. The controller 80 is, for example, a microcomputer. The microcomputer is not limited to any particular hardware configuration. In one example, the microcomputer includes: an interface (I/F) to receive print data and/or other data from an external device, such as a host computer; a central processing unit (CPU) to execute commands included in a control program; a read-only memory (ROM) storing the program to be executed by the CPU; a random-access memory (RAM) for use as a working area where the program is to be expanded; and a storage device, such as a memory, to store the program and/or various data. The controller 80 does not necessarily have to be provided inside the printer 10. Alternatively, the controller 80 may be, for example, a computer external to the printer 10 and connected to the printer 10 so as to enable wire or wireless communication between the controller 80 and the printer 10.

The space which is located below the platen 20 and in which the controller 80 is housed is surrounded by plate-like panels. A control panel 90 is fitted into a front one of the panels. The control panel 90 faces forward of the printer 10. The control panel 90 is electrically connected to the controller 80. The control panel 90 includes, for example, a display to present a device status and/or other information and input key(s) to be operated to set printing condition(s) and/or other condition(s).

The printing jig 100 will be described below. As previously described, the printing jig 100 includes: the base plates 110 fitted to the printer 10; the first holding units 120A; the second holding units 120B; and the third holding units 120C. The first, second, and third holding units 120A, 120B, and 120C are each configured to be fittable to a fitted portion of an associated one of the base plates 110. In other words, the holding units are fittable to the base plates 110 on a one-to-one basis, and the holding unit fittable to each of the base plates 110 is thus one of the first, second, and third holding units 120A, 120B, and 120C.

In the present preferred embodiment, the number of types of holding units is three because the number of types of substrates 5 is three. Alternatively, the number of types of holding units may be increased or reduced in accordance with the number of types of substrates 5. In one example, when the substrates 5 include the first and second substrates 5A and 5B, the holding units may include the first and second holding units 120A and 120B. When the substrates 5 include four or more types of substrates, the holding units may include four or more types of holding units. The number of holding units attachable to and detachable from each base plate 110 may be two or more. The number of types of holding units is not limited to any particular number. The number of holding units fittable to each base plate 110 is not limited to any particular number.

In the present preferred embodiment, the base plates 110 are identical or substantially identical. The positions of portions of the base plates 110 that come into abutment with the stoppers 35LF, 35LR, 35RF, and 35RR, for example, may be different from each other. The base plates 110 are similar in outer dimensions. The base plates 110 are similar in configuration of the fitted portions to which the holding units are to be fitted. The four base plates 110 may be identical.

Figure 4:
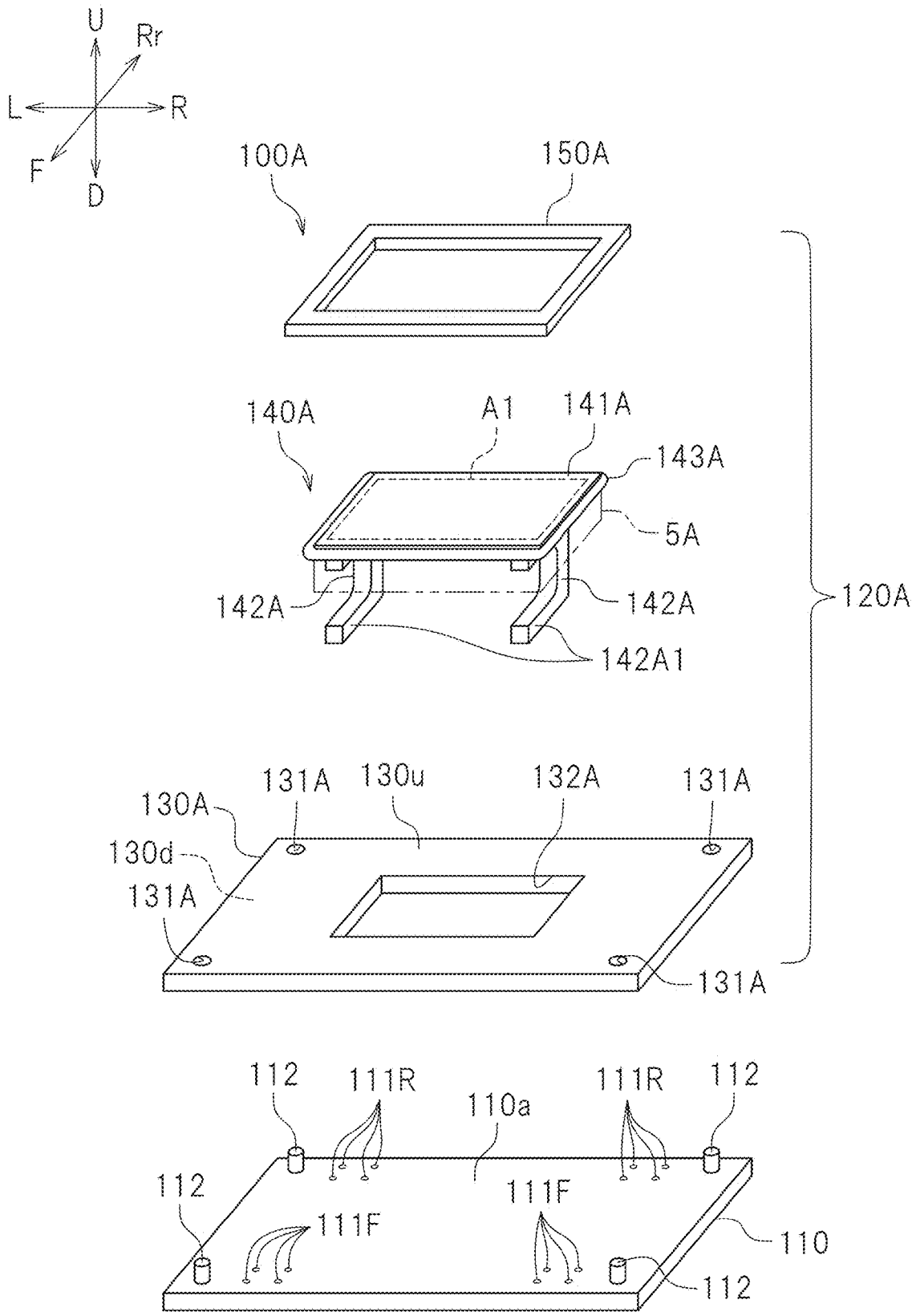
FIG. 4 is a schematic perspective view of a first set.
Figure 5:
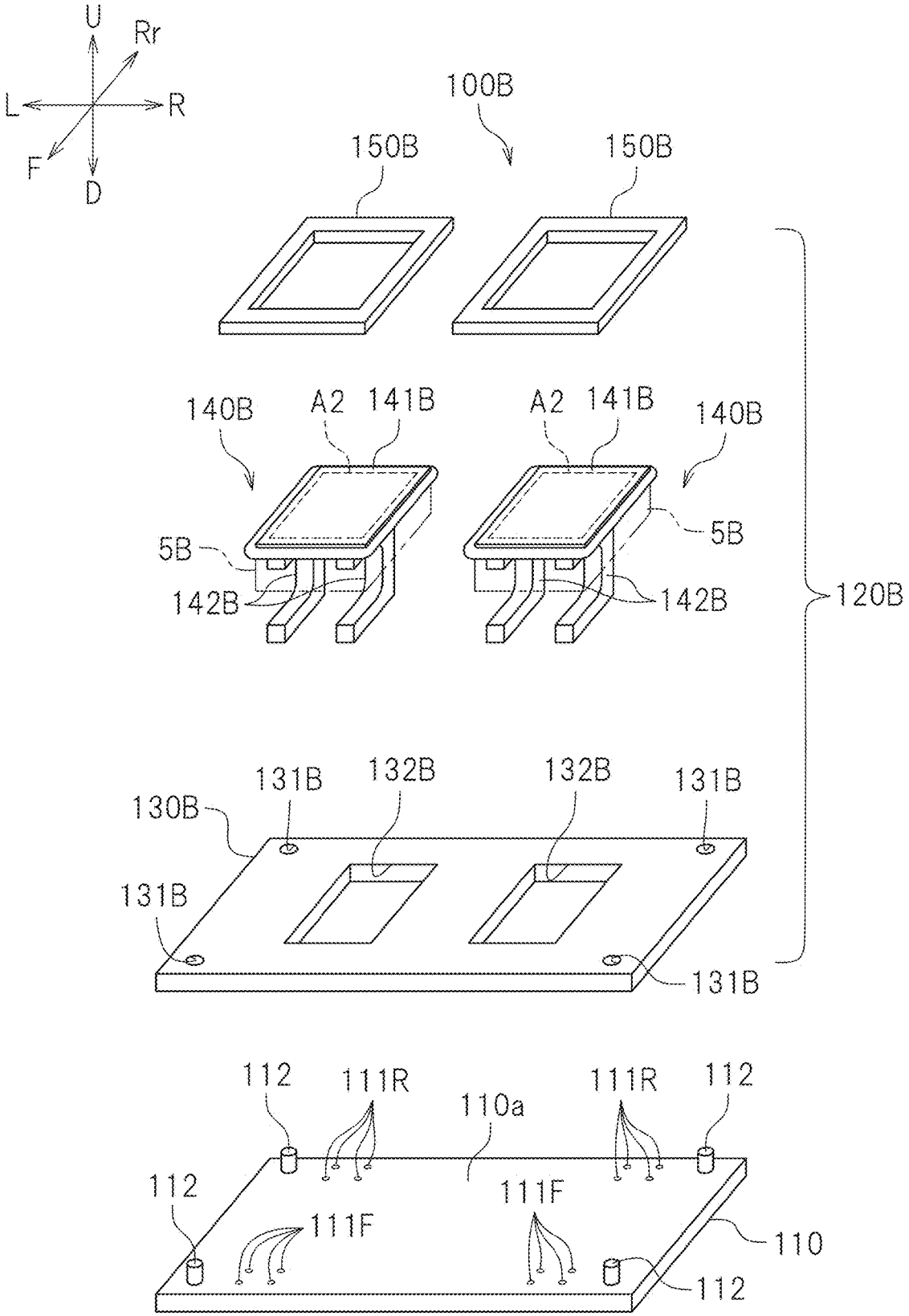
FIG. 5 is a schematic perspective view of a second set.
Figure 6:
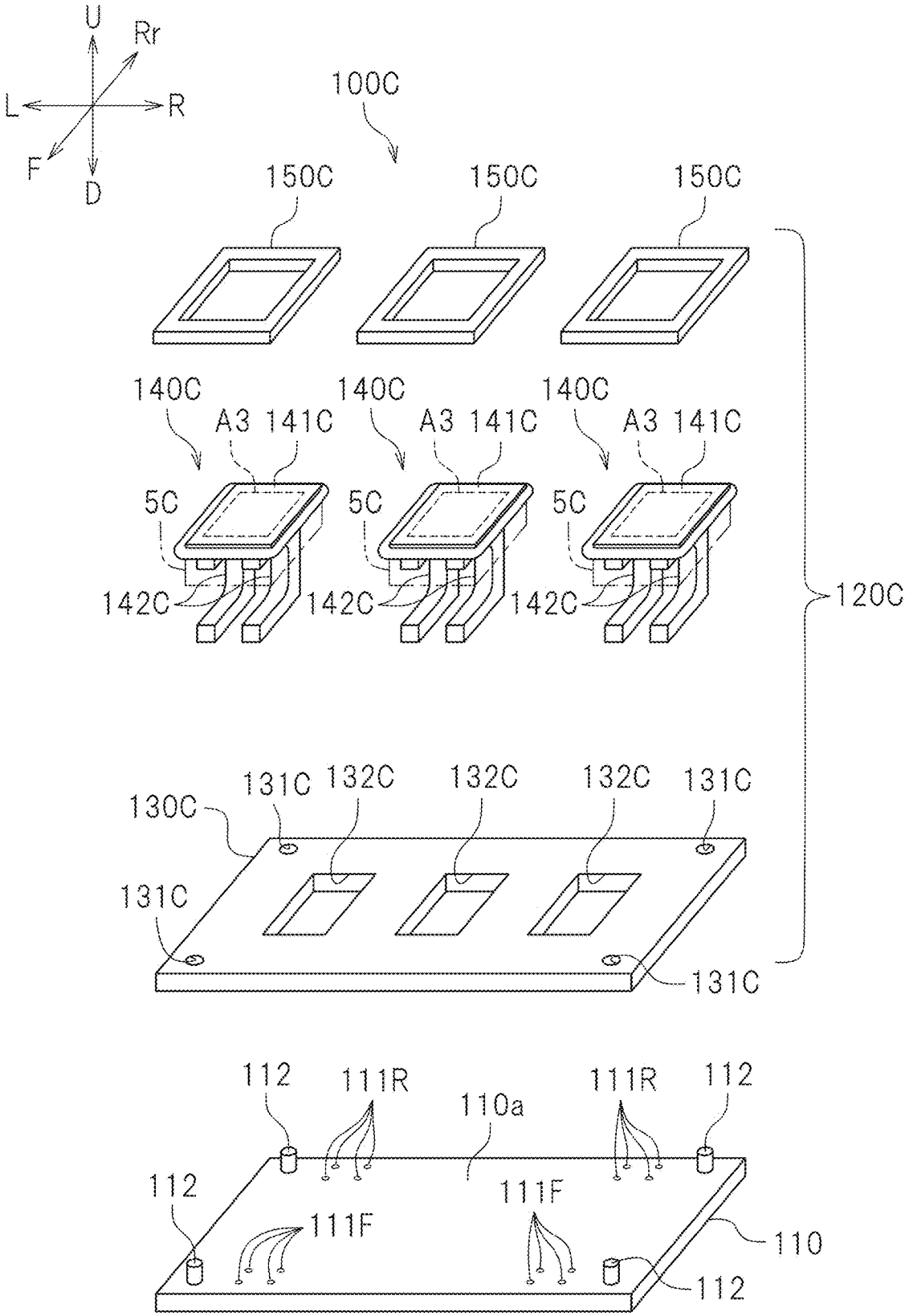
FIG. 6 is a schematic perspective view of a third set.

FIG. 4 is a schematic perspective view of a set (hereinafter referred to as a "first set 100A" for the sake of convenience) in which one first holding unit 120A is fitted to one base plate 110. The first set 100A is a set for which settings are made such that the set is adaptable to the first substrate 5A. FIG. 5 is a schematic perspective view of a set (hereinafter referred to as a "second set 100B" for the sake of convenience) in which one second holding unit 120B is fitted to one base plate 110. The second set 100B is a set for which settings are made such that the set is adaptable to the second substrates 5B. FIG. 6 is a schematic perspective view of a set (hereinafter referred to as a "third set 100C" for the sake of convenience) in which one third holding unit 120C is fitted to one base plate 110. The third set 100C is a set for which settings are made such that the set is adaptable to the third substrates 5C. The components of the first set 100A, the components of the second set 100B, and the components of the third set 100C, which are respectively illustrated in FIGS. 4, 5, and 6, are exploded in the up-down direction.

As illustrated in FIG. 4, the first holding unit 120A includes a first docking member 130A, a first holding member 140A, and a first holding frame 150A. The first docking member 130A is configured to be fittable to the base plate 110. The first holding member 140A is fitted to the first docking member 130A. In this preferred embodiment, the first holding member 140A is configured to be able to hold one first substrate 5A. In this preferred embodiment, the number of first holding members 140A fittable to the first docking member 130A is one. Alternatively, two or more first holding members 140A may be fittable to the first docking member 130A. In this case, the first holding unit 120A includes two or more first holding members 140A each capable of holding one first substrate 5A and is thus able to hold two or more first substrates 5A. The first holding frame 150A is a member to fix the first substrate 5A such that the first substrate 5A is sandwiched between the first holding frame 150A and the first holding member 140A in the up-down direction.

The number of first substrates 5A the first holding unit 120A is able to hold may hereinafter be referred to as a "first quantity". In this preferred embodiment, the first quantity is one. The first quantity, however, is not limited to one.

The second holding unit 120B is similar in configuration to the first holding unit 120A. As illustrated in FIG. 5, the second holding unit 120B includes a second docking member 130B, second holding members 140B, and second holding frames 150B. The second docking member 130B is configured to be fittable to the base plate 110. The second holding members 140B are each fitted to the second docking member 130B. The second holding members 140B are each configured to be able to hold one second substrate 5B. The number of second holding members 140B, i.e., the number of second substrates 5B the second holding unit 120B is able to hold, may hereinafter be referred to as a "second quantity". In this preferred embodiment, the second quantity is two.

The third holding unit 120C is similar in configuration to the first holding unit 120A and the second holding unit 120B. As illustrated in FIG. 6, the third holding unit 120C includes a third docking member 130C, third holding members 140C, and third holding frames 150C. The number of third holding members 140C, i.e., the number of third substrates 5C the third holding unit 120C is able to hold, may hereinafter be referred to as a "third quantity". In this preferred embodiment, the third quantity is three.

The first, second, and third quantities are respectively determined in accordance with the sizes of the first, second, and third substrates 5A, 5B, and 5C with respect to the base plates 110. In the present preferred embodiment, the first substrates 5A are larger than the second substrates 5B, and the second substrates 5B are larger than the third substrates 5C. Accordingly, the first quantity is smaller than the second quantity, and the second quantity is smaller than the third quantity. In the present preferred embodiment, the first, second, and third quantities differ from each other. Alternatively, any two or all of the first, second, and third quantities may be identical. In one example, the second quantity may be larger than the first quantity and equal to the third quantity.

In the present preferred embodiment, the number of first holding units 120A to be prepared, the number of second holding units 120B to be prepared, and the number of third holding units 120C to be prepared are each equal to or larger than the number of base plates 110. As illustrated in FIG. 3, the number of base plates 110 is four in the present preferred embodiment, and four or more first holding units 120A, four or more second holding units 120B, and four or more third holding units 120C are prepared accordingly. This makes it possible to fit the first, second, and third holding units 120A, 120B, and 120C to the base plates 110 in various patterns. In one example, the same type of holding unit (e.g., the first holding units 120A) may be fitted to all of the base plates 110. In another example, one type of holding unit may be fitted to at least one of the base plates 110, and the other type(s) of holding unit(s) may be fitted to the other base plate(s) 110. When the number of first holding units 120A, the number of second holding units 120B, and the number of third holding units 120C are each equal to or larger than the number of base plates 110 as described above, the printing jig 100 is flexibly adaptable to various combinations of the substrates 5 of various sizes. In this preferred embodiment, the printer 10 is able to effect printing on any of various combinations of the first substrates 5A (which are L size T-shirts), the second substrates 5B (which are M size T-shirts), and the third substrates 5C (which are S size T-shirts) at a time.

The first set 100A, the second set 100B, and the third set 100C will be described in detail below. Because the second set 100B and the third set 100C are similar in configuration to the first set 100A, the description of the second set 100B focuses on differences between the second set 100B and the first set 100A, and the description of the third set 100C focuses on differences between the third set 100C and the first set 100A. Unless otherwise specified, directions mentioned in the following description refer to directions in a state where settings are made for components so as to enable the substrates 5 to be held.

First, the first set 100A will be described. As previously described, the first set 100A includes one base plate 110 and one first holding unit 120A. The length of the base plate 110 in the right-left direction is longer than the length of the base plate 110 in the front-rear direction in accordance with the longitudinal direction of the platen 20. The base plate 110 has a substantially rectangular shape in which its length in the right-left direction is longer than its length in the front-rear direction in the plan view.

As illustrated in FIG. 4, the base plate 110 includes front bolt holes 111F. The front bolt holes 111F are holes that allow passage of bolts (not illustrated) to fasten the base plate 110 and the front linear-motion block 32F or 33F (see FIG. 2) together. The base plate 110 further includes rear bolt holes 111R that allow passage of bolts (not illustrated) to fasten the base plate 110 and the rear linear-motion blocks 32R or 33R (see FIG. 2) together. The front bolt holes 111F and the rear bolt holes 111R pass through the base plate 110 in the up-down direction. The front bolt holes 111F and the rear bolt holes 111R are provided with counter bores in which the heads of the bolts are sunk such that the bolts do not project above an upper surface 110*a* of the base plate 110. The first holding unit 120A is placed on the upper surface 110*a* of the base plate 110.

The base plate 110 includes positioning pins 112 defining and functioning as the fitted portion to which the first holding unit 120A, the second holding unit 120B, or the third holding unit 120C is to be fitted. In this preferred embodiment, the positioning pins 112 are each provided in an associated one of the four corners of the upper surface 110*a* of the base plate 110. The positioning pins 112 each extend upward from the upper surface 110*a*. The number of positioning pins 112 may be two or may be three or more. The fitted portion is not limited to a configuration including the positioning pins 112. In one example, the fitted portion may be recess(es) into which the first holding unit 120A, the second holding unit 120B, or the third holding unit 120C is to be inserted, or may be hole(s) into which pin(s) and/or other component(s) of the first holding unit 120A, the second holding unit 120B, or the third holding unit 120C is/are to be inserted. The fitted portion is not limited to any particular configuration.

As illustrated in FIG. 4, the first docking member 130A has a flat plate shape. The first docking member 130A is substantially identical in shape to the base plate 110 in the plan view. Similarly to the base plate 110, the first docking member 130A has a substantially rectangular shape in which its length in the right-left direction is longer than its length in the front-rear direction in the plan view. The first docking member 130A is fitted to the base plate 110 so as to be overlaid on the base plate 110. The first docking member 130A includes a first fitting portion to be fitted to the base plate 110. To be more specific, the first fitting portion is fitted to the positioning pins 112 defining and functioning as the fitted portion of the base plate 110. In this preferred embodiment, the first fitting portion is pin holes 131A as illustrated in FIG. 4. The pin holes 131A are each provided in an associated one of the four corners of the first docking member 130A.

The position of each of the pin holes 131A defining and functioning as the first fitting portion corresponds to the position of an associated one of the positioning pins 112 defining and functioning as the fitted portion. The pin holes 131A each extend upward from a lower surface 130*d* of the first docking member 130A to a depth at which at least the associated positioning pin 112 is completely insertable. The pin holes 131A may pass through the first docking member 130A in the up-down direction. Bringing the first docking member 130A close to the base plate 110 from above such that the first docking member 130A is overlaid on the base plate 110 inserts each of the positioning pins 112 into an associated one of the pin holes 131A. The first docking member 130A is thus fitted to the base plate 110, so that the positional relationship therebetween is determined.

As illustrated in FIG. 4, the first docking member 130A includes a first recess 132A. The first recess 132A is defined in an upper surface 130*u* of the first docking member 130A, with the first docking member 130A fitted to the base plate 110. In this preferred embodiment, the first recess 132A is a through hole defined such that the through hole passes through the upper surface 130*u* and the lower surface 130*d* of the first docking member 130A. The first recess 132A may hereinafter be referred to as a "first through hole 132A". The first recess 132A is simply required to be recessed below the upper surface 130*u* of the first docking member 130A so as to house a portion of the first holding member 140A and effect positioning of the first holding member 140A. No further limitations are imposed on the first recess 132A. The first recess 132A may be, for example, a recess that does not pass through the first docking member 130A. In the present preferred embodiment, the number of first through holes 132A corresponds to the first quantity, which means that the number of first through holes 132A is one. The first holding member 140A is fitted into the first through hole 132A. As illustrated in FIG. 4, the first through hole 132A has a substantially quadrangular shape in the plan view. To be more specific, the first through hole 132A has a substantially rectangular shape in which its length in the right-left direction is longer than its length in the front-rear direction in the plan view. The right-left direction corresponds to the longitudinal direction of the platen 20. The planar shape of the first through hole 132A, however, is not limited to a quadrangular shape.

The first holding member 140A includes: a first support 141A to support the first substrate 5A; and a pair of first legs 142A supporting the first support 141A from below. As illustrated in FIG. 4, the first support 141A is located above the first docking member 130A when the first holding member 140A is fitted to the first docking member 130A. The lower portions of the pair of first legs 142A are fitted into the first through hole 132A.

As illustrated in FIG. 4, the first support 141A has a quadrangular flat plate shape in the plan view. To be more specific, the first support 141A has a substantially rectangular shape in which its length in the right-left direction is longer than its length in the front-rear direction in the plan view in accordance with the longitudinal direction of the platen 20. With the first legs 142A fitted to the first docking member 130A, the first support 141A is kept substantially parallel to the base plate 110 and the first docking member 130A (i.e., substantially horizontal in this preferred embodiment). The first substrate 5A is placed on the first support 141A. A print region (hereinafter referred to as a "first print region A1") on the first substrate 5A is set inward of the first support 141A. As used herein, the term "print region" refers to a maximum printable region. In the present preferred embodiment, the first print region A1 has a rectangular shape and is set such that the longitudinal direction of the first print region A1 corresponds to the right-left direction. The shape of the first print region A1, however, is not limited to any particular shape.

As illustrated in FIG. 4, a portion of the first substrate 5A outward of the first support 141A hangs downward from the outer edge of the first support 141A. In this preferred embodiment, the first substrate 5A is a T-shirt made of overlaid fabrics that are flexible sheet materials. In the present preferred embodiment, the first substrate 5A is larger than the first support 141A in the plan view. Thus, a portion of the first substrate 5A protrudes from the outer edge of the first support 141A and hangs downward therefrom. The first support 141A is supported above the first docking member 130A by the first legs 142A such that the portion of the first substrate 5A outward of the first support 141A is allowed to hang down.

As previously described, the substrates 5 are not limited to any particular type or types or any particular property or properties. In one example, the substrates 5 may be flexible sheet materials, examples of which include non-overlaid fabrics, resin sheets, and paper. Also in this case, a portion of the substrate 5 outward of the first support 141A hangs down from the outer edge of the first support 141A. Alternatively, the substrate 5 may be a non-flexible material. In this case, the substrate 5 does not hang down from the first support 141A.

The pair of first legs 142A is disposed such that the first legs 142A are in alignment with each other in the right-left direction. The pair of first legs 142A extends downward from the first support 141A and then bends forward. Portions of the first legs 142A extending in the front-rear direction define a pair of contact portions 142A1 to be fitted into the first through hole 132A. The pair of contact portions 142A1 forms prismatic shapes. The length of the pair of contact portions 142A1 in the front-rear direction is equal to the length of the first through hole 132A in the front-rear direction. A distance between the left end of the left contact portion 142A1 and the right end of the right contact portion 142A1 in the right-left direction (i.e., the outside length of the pair of contact portions 142A1 in the right-left direction) is equal to the length of the first through hole 132A in the right-left direction. Thus, the pair of contact portions 142A1 is inserted into the first through hole 132A such that the front, rear, left, and right outer side surfaces of the pair of contact portions 142A1 respectively come into contact with the front, rear, left, and right inner side surfaces of the first through hole 132A. The pair of contact portions 142A1 is supported by the base plate 110 such that the lower surface of the pair of contact portions 142A1 is in contact with the upper surface 110*a* of the base plate 110. This effects positioning of the first holding member 140A and the base plate 110 through the first docking member 130A. The contact portions 142A1 are simply required to be configured so as to allow positioning of the contact portions 142A1 with respect to the first through hole 132A. No limitations are imposed on, for example, the shapes of the contact portions 142A1. In one example, the contact portions 142A1 may have a substantially rectangular shape approximately identical to the shape of the first through hole 132A.

As illustrated in FIG. 4, the first holding member 140A includes a first elastic body 143A provided on the side surfaces of the first support 141A. The first elastic body 143A is made of, for example, elastic rubber. The first elastic body 143A, however, is not limited to any particular material. In this preferred embodiment, the first elastic body 143A is provided across an entirety of each side surface of the first support 141A. The first elastic body 143A protrudes outward of the side surfaces of the first support 141A.

In the plan view, the first holding frame 150A has a quadrangular shape with a space defined therein. In the plan view, the space defined inside the first holding frame 150A is slightly larger than the first support 141A and slightly smaller than a space defined inside the visible outline of the first elastic body 143A. The first holding frame 150A is configured to be fittable to the outer side of the first support 141A and the first elastic body 143A while the first elastic body 143A is elastically deformed.

As illustrated in FIG. 4, the first substrate 5A is placed on the first support 141A such that the portion of the first substrate 5A protruding from the first support 141A hangs down, and then the first holding frame 150A is fitted to the first support 141A. This elastically deforms the first elastic body 143A so as to hold the first substrate 5A and the first holding frame 150A. The first substrate 5A is held with a frictional force generated between the first elastic body 143A and the hanging portion of the first substrate 5A, with the first elastic body 143A being elastically deformed.

As previously described, the second set 100B is similar in configuration to the first set 100A. As mentioned above, the base plate 110 of the second set 100B may be identical to the base plate 110 of the first set 100A. In the present preferred embodiment, the second docking member 130B is similar to the first docking member 130A except for the number of second through holes 132B and the size of each second through hole 132B. As illustrated in FIG. 5, the second docking member 130B includes pin holes 131B defining and functioning as a second fitting portion to be fitted to the base plate 110. The pin holes 131B defining and functioning as the second fitting portion are similar in configuration to the pin holes 131A (see FIG. 4) defining and functioning as the first fitting portion. The positioning pins 112 of each base plate 110, which define and function as the fitted portion, each conform to an associated one of the pin holes 131A defining and functioning as the first fitting portion and an associated one of the pin holes 131B defining and functioning as the second fitting portion. In this preferred embodiment, the fact that the positioning pins 112 of each base plate 110, which define and function as the fitted portion, each "conform to" an associated one of the pin holes 131A defining and functioning as the first fitting portion and an associated one of the pin holes 131B defining and functioning as the second fitting portion means that each positioning pin 112 is fittable to an associated one of the pin holes 131A and an associated one of the pin holes 131B. Thus, each positioning pin 112 is not particularly required to conform to an associated one of the pin holes 131A and an associated one of the pin holes 131B in other respects. In other words, the positioning pins 112 of each base plate 110, which define and function as the fitted portion, are simply required to be configured such that the pin holes 131A defining and functioning as the first fitting portion and the pin holes 131B defining and functioning as the second fitting portion are each fittable to an associated one of the positioning pins 112.

As illustrated in FIG. 5, the second docking member 130B includes the second through holes 132B, the number of which corresponds to the second quantity (which is two in this preferred embodiment, for example). Each second through hole 132B is smaller in size than the first through hole 132A. This is because each second substrate 5B is smaller than the first substrate 5A, and a print region on each second substrate 5B (which will hereinafter be referred to as a "second print region A2") is smaller than the first print region A1 (see FIG. 4) on the first substrate 5A. When the substrates 5 are flexible, the number of substrates 5 each holding member is able to hold may be set in accordance, not with the size of each substrate 5, but with the size of each print region. The first print region A1 with a predetermined size is set on a surface of the first substrate 5A, and the second print region A2 smaller than the first print region A1 in the plan view is set on a surface of each second substrate 5B. Accordingly, the second quantity may be set to be larger than the first quantity. In the present preferred embodiment, the second quantity is two, so that the second quantity is set to be larger than the first quantity.

In the present preferred embodiment, the second docking member 130B has a substantially rectangular shape in which its length in the right-left direction is longer than its length in the front-rear direction in the plan view similarly to the base plate 110 and the first docking member 130A. The right-left direction corresponds to the longitudinal direction of the platen 20. The second through holes 132B, the number of which corresponds to the second quantity, are disposed in alignment with each other in the right-left direction in the second docking member 130B. The number of second through holes 132B disposed in the front-rear direction is one. The second through holes 132B, however, may be disposed in alignment with each other in the front-rear direction in the second docking member 130B.

In the present preferred embodiment, the second through holes 132B of the second docking member 130B are provided such that the width direction of each second through hole 132B corresponds to the right-left direction unlike the first through hole 132A of the first docking member 130A. Accordingly, the length of each second through hole 132B in the right-left direction is shorter than when the longitudinal direction of each second through hole 132B corresponds to the right-left direction. The second docking member 130B is thus configured so as to facilitate disposing a larger number of the second through holes 132B in alignment with each other in the right-left direction. As illustrated in FIG. 5, the longitudinal direction of each second print region A2 and the longitudinal direction of each second support 141B correspond to the front-rear direction similarly to the longitudinal direction of each the second through hole 132B.

The orientation in which the first and second substrates 5A and 5B according to the present preferred embodiment are to be held is set for the purpose of holding a larger number of the substrates 5 with the printing jig 100 and is thus merely illustrative. The longitudinal direction of the print regions on the first and second substrates 5A and 5B may be set to correspond to the right-left direction or may be set to correspond to the front-rear direction.

As illustrated in FIG. 5, the second holding members 140B are similar in configuration to the first holding member 140A except for the lengths of the second holding members 140B in the right-left direction and the front-rear direction. In accordance with the size of each second print region A2, the second support 141B of each second holding member 140B is smaller in size than the first support 141A of the first holding member 140A in the plan view. In accordance with the size of each second through hole 132B, second legs 142B of each second holding member 140B are smaller in size than the first legs 142A of the first holding member 140A in the plan view. The position of each second support 141B supported by the second legs 142B in the up-down direction is similar to the position of the first support 141A supported by the first legs 142A in the up-down direction.

The second holding frames 150B are similar to the first holding frame 150A except for the lengths of the second holding frames 150B in the right-left direction and the front-rear direction. The second holding frames 150B have sizes adaptable to the second supports 141B.

The third set 100C is similar in configuration to the first set 100A and the second set 100B. As illustrated in FIG. 6, the base plate 110 of the third set 100C may be identical to the base plate 110 of the first set 100A. The third docking member 130C is similar to the first docking member 130A and the second docking member 130B except for the number of third through holes 132C and the size of each third through hole 132C. Pin holes 131C defining and functioning as a third fitting portion are similar in configuration to the pin holes 131A (see FIG. 4) defining and functioning as the first fitting portion and the pin holes 131B (see FIG. 5) defining and functioning as the second fitting portion. As illustrated in FIG. 6, the third docking member 130C includes the third through holes 132C, the number of which corresponds to the third quantity (which is three in this preferred embodiment). The third substrates 5C are smaller than the second substrates 5B. A third print region A3 smaller than the second print region A2 in the plan view is set on a surface of each third substrate 5C. Each third through hole 132C is thus smaller in size than each second through hole 132B. Accordingly, the third quantity may be set to be larger than the second quantity. In the present preferred embodiment, the third quantity is three, so that the third quantity is set to be larger than the second quantity.

The third docking member 130C has a substantially rectangular shape in which its length in the right-left direction is longer than its length in the front-rear direction in the plan view similarly to the first docking member 130A and the second docking member 130B. The third through holes 132C, the number of which corresponds to the third quantity, are disposed in alignment with each other in the right-left direction in the third docking member 130C. The number of third through holes 132C disposed in the front-rear direction is one. The third through holes 132C are provided such that the longitudinal direction of each third through hole 132C corresponds to the front-rear direction.

As illustrated in FIG. 6, the third holding members 140C are similar in configuration to the first holding member 140A and the second holding members 140B except for the lengths of the third holding members 140C in the right-left direction and the front-rear direction. In accordance with the size of each third print region A3, a third support 141C of each third holding member 140C is smaller in size than the second support 141B of each second holding member 140B in the plan view. In accordance with the size of each third through hole 132C, third legs 142C of each third holding member 140C are smaller in size than the second legs 142B of each second holding member 140B in the plan view. The position of each third support 141C supported by the third legs 142C in the up-down direction is similar to the position of the first support 141A supported by the first legs 142A in the up-down direction and the position of each second support 141B supported by the second legs 142B in the up-down direction.

The third holding frames 150C are similar to the first holding frame 150A and the second holding frames 150B except for the lengths of the third holding frames 150C in the right-left direction and the front-rear direction. The third holding frames 150C have sizes adaptable to the third supports 141C.

In the present preferred embodiment, the first, second, and third holding units 120A, 120B, and 120C (i.e., the units provided by fitting the holding members and the holding frames to the docking members in this preferred embodiment) are configured such that the first, second, and third holding units 120A, 120B, and 120C are each longer in the right-left direction than in the front-rear direction, and the number of substrates 5 each of the first, second, and third holding units 120A, 120B, and 120C is able to hold in the right-left direction is equal to or larger than the number of substrates 5 each of the first, second, and third holding units 120A, 120B, and 120C is able to hold in the front-rear direction. The number of substrates 5 each of the second and third holding units 120B and 120C is able to hold in the right-left direction is larger than the number of substrates 5 each of the second and third holding units 120B and 120C is able to hold in the front-rear direction. The number of substrates 5 the first holding unit 120A is able to hold in the right-left direction is equal to the number of substrates 5 the first holding unit 120A is able to hold in the front-rear direction. In the present preferred embodiment, the number of substrates 5 the first holding unit 120A is able to hold in the right-left direction and the number of substrates 5 the first holding unit 120A is able to hold in the front-rear direction are both one. Alternatively, the number of substrates 5 the first holding unit 120A is able to hold in the right-left direction may be larger than the number of substrates 5 the first holding unit 120A is able to hold in the front-rear direction.

Figure 7:
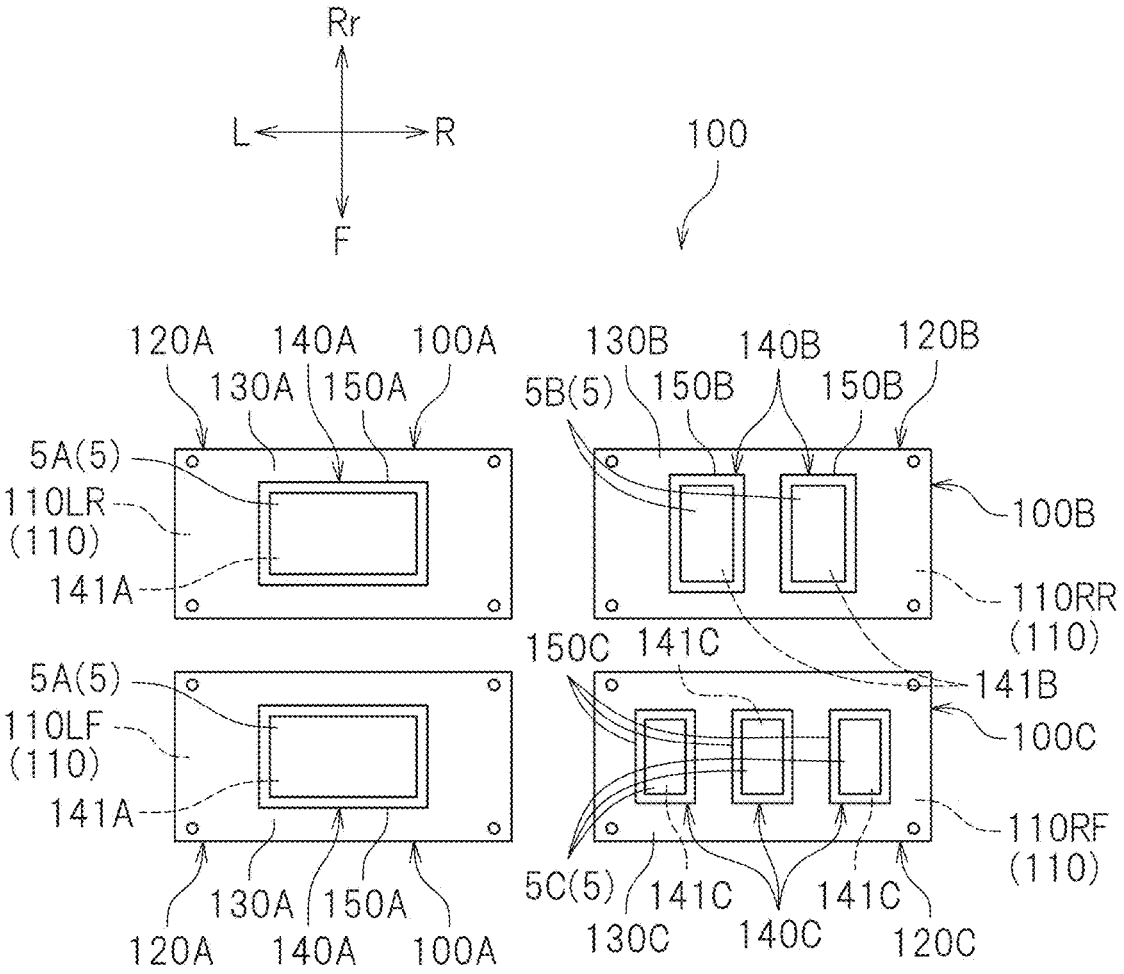
FIG. 7 is a schematic plan view illustrating an exemplary combination of holding units.

The following description discusses a process for holding the substrates 5 with the printing jig 100, a printing process, and effects of the present preferred embodiment. FIG. 7 is a schematic plan view illustrating an exemplary combination of the holding units. In the example illustrated in FIG. 7, the left front base plate 110 (which may hereinafter be referred to as a "base plate 110LF" as appropriate) is provided to make settings for the first set 100A. The right front base plate 110 (which may hereinafter be referred to as a "base plate 110RF" as appropriate) is provided to make settings for the third set 100C. The left rear base plate 110 (which may hereinafter be referred to as a "base plate 110LR" as appropriate) is provided to make settings for the first set 100A. The right rear base plate 110 (which may hereinafter be referred to as a "base plate 110RR" as appropriate) is provided to make settings for the second set 100B.

In other words, the first holding unit 120A is fitted to the base plate 110LF. The first holding units 120A are fitted to the base plates 110LF and 110LR. The second holding unit 120B is fitted to the base plate 110RR. The third holding unit 120C is fitted to the base plate 110RF. The combination of the holding units with the base plates 110LF, 110RF, 110LR, and 110RR may be freely changed.

The printing jig 100 according to the present preferred embodiment includes the first, second, and third holding units 120A, 120B, and 120C that are able to respectively hold the first, second, and third substrates 5A, 5B, and 5C. Any of the first, second, and third holding units 120A, 120B, and 120C is fittable to each of the base plates 110. Thus, selecting the holding unit to be fitted to each of the base plates 110 enables the printing jig 100 to simultaneously hold the first, second, and third substrates 5A, 5B, and 5C different in size. In this preferred embodiment, the fitted portions of the base plates 110 include all the same positioning pins 112. The fitting portions of the first, second, and third holding units 120A, 120B, and 120C include all the same pin holes 131A, 131B, and 131C. The fitting portions of the holding units 120A, 120B, and 120C are able to be fitted to any one of the fitted portions of the base plates 110. Because the first, second, and third holding units 120A, 120B, and 120C are all fittable to similar fitted portions of the base plates 110, the printing jig 100 is able to hold two or more types of the substrates 5 different in size more efficiently than when the first, second, and third holding units 120A, 120B, and 120C are fitted to, for example, different locations on the base plates 110, or for example, when the first, second, and third holding members 140A, 140B, and 140C are fitted to the base plates 110 directly. This enables efficient utilization of a printing area of the printer 10.

The printing jig 100 configured such that the holding units are fitted to the base plates 110 including the similar fitted portions would make it unnecessary to change the base plate(s) 110 if, for example, the shape(s) of the substrate(s) 5 is/are changed or other type(s) of the substrate(s) 5 is/are added. Thus, the printing jig 100 configured as described above is flexibly adaptable to variations of the substrates 5. With this configuration, the substrates 5 may be held by the holding units in advance, and then the holding units may be fitted to the base plates 110. Consequently, a user is able to efficiently perform an operation for holding the substrates 5 in the printing jig 100.

The present preferred embodiment includes preparing two or more first holding units 120A, two or more second holding units 120B, and two or more third holding units 120C. This further increases the degree of flexibility in selecting which of the holding units is to be fitted to each of the base plates 110. The printing jig 100 configured as described above is flexibly adaptable to various ratios between the number of first holding units 120A, the number of second holding units 120B, and the number of third holding units 120C. In the present preferred embodiment, the number of first holding units 120A, the number of second holding units 120B, and the number of third holding units 120C, in particular, are each equal to or larger than the number of base plates 110. This makes it possible to freely select which of the holding units is to be fitted to each of the base plates 110 without limitation.

More specifically, an operation for making settings for the printing jig 100 or changing settings for the printing jig 100 will be performed, for example, in a manner described below. First, a user fits a desired one of the first, second, and third docking members 130A, 130B, and 130C to each of the four base plates 110 (i.e., the base plates 110LF, 110RF, 110LR, and 110RR). The user then fits each of the holding members to a predetermined number of recesses (or through holes) of an associated one of the docking members. To be more specific, when the printing jig 100 includes the first set 100A, the user fits the first holding member 140A to the single first through hole 132A of the first docking member 130A (see FIG. 4). The number of first through holes 132A in this case corresponds to the first quantity. When the printing jig 100 includes the second set 100B, the user fits each of the second holding members 140B to an associated one of the two second through holes 132B of the second docking member 130B (see FIG. 5). The number of second through holes 132B in this case corresponds to the second quantity. When the printing jig 100 includes the third set 100C, the user fits each of the third holding members 140C to an associated one of the three third through holes 132C of the third docking member 130C (see FIG. 6). The number of third through holes 132C in this case corresponds to the third quantity.

In the present preferred embodiment, the holding units are each divided into a docking member and holding member(s), and the docking members are fitted to the base plates 110. This makes it possible to simplify the configuration of each base plate 110 and facilitate an operation for fitting the holding units to the base plates 110. The holding members holding the substrates 5, for example, may be directly attachable to the base plates 110. In this case, however, performing functions similar to those of the printing jig 100 according to the present preferred embodiment requires that each base plate 110 be provided with, for example, first fitted portions which conform to the first holding member 140A and the number of which corresponds to the first quantity, second fitted portions which conform to the second holding members 140B and the number of which corresponds to the second quantity, and third fitted portions which conform to the third holding members 140C and the number of which corresponds to the third quantity. This complicates the configuration of each base plate 110. In addition, the user needs to check the complicated fitted portions in selecting the fitted portions to be used, resulting in a complicated operation for fitting the holding members to the base plates 110. In contrast, the present preferred embodiment involves attaching the holding members to the base plates 110 through the docking members, and preparing the docking members having similar fitting portions. This simply requires that each base plate 110 be provided with a single fitted portion to which the similar fitting portions of the docking members are fittable. When two or more docking members are fittable to each base plate 110, each base plate 110 is simply required to be provided with two or more similar fitted portions. This makes it possible to simplify the configuration of each base plate 110. Operations for fitting the docking members to the base plates 110 are similar, and each docking member has only associated holding member (s) fitted thereto. The first docking member 130A, for example, has only the first holding member 140A fitted thereto. Accordingly, the present preferred embodiment facilitates an operation for fitting the holding units to the base plates 110, which is to be performed by the user.

In the present preferred embodiment, the first to third docking members 130A to 130C are fitted to the base plates 110LF to 110RR by performing a simple operation that involves overlaying the first to third docking members 130A to 130C on the base plates 110LF to 110RR from above. The first to third holding members 140A to 140C are fitted to the first to third docking members 130A to 130C by performing a simple operation that involves inserting the first to third holding members 140A to 140C into the recesses (which are the first to third through holes 132A to 132C in this preferred embodiment) of the first to third docking members 130A to 130C. The user is thus able to easily perform the operation for holding the substrates 5 in the printing jig 100.

In the present preferred embodiment, the first, second, and third recesses are respectively defined by the first, second, and third through holes 132A, 132B, and 132C, thus reducing the weight of each of the first, second, and third docking members 130A, 130B, and 130C. This further facilitates an operation for fitting the first to third docking members 130A to 130C to the base plates 110 and a sliding operation that involves moving each base plate 110 between the setting position P2 and the printing position P1.

The user subsequently places the substrates 5 on the supports 141A to 141C of the holding members 140A to 140C. The user also fits the holding frames 150A to 150C to the supports 141A to 141C. This effects positioning of the substrates 5 with respect to the printing jig 100 and fixes the substrates 5 to the printing jig 100. At this point, portions of the substrates 5 protruding from the supports 141A to 141C hang down from the outer edges of the supports 141A to 141C. Thus, the protruding portion of each substrate 5 is prevented from overlapping with the other support(s) and interfering with printing to be effected on the other substrate(s) 5. Lifting the supports 141A to 141C by the legs 142A to 142C as described above makes it possible to hold a larger number of the substrates 5 when the substrates 5 are flexible.

In the present preferred embodiment, the number of small-sized substrates 5 to be held by an associated one of the holding units is larger than the number of large-sized substrates 5 to be held by an associated one of the holding units. In one example, the number of second substrates 5B smaller in size and to be held by an associated one of the holding units is larger than the number of first substrates 5A larger in size and to be held by an associated one of the holding units. Thus, the printing jig 100 enables the printer 10 to simultaneously effect printing on a larger number of the substrates 5. In the present preferred embodiment, the number of substrates 5 each holding unit is able to hold is set in accordance with the sizes of the substrates 5 in order to efficiently utilize the printing area of the printer 10. Preparing two or more types of holding units (which are the first to third holding units 120A to 120C in this preferred embodiment) adaptable to two or more types of substrates 5 different in size makes it possible to simultaneously hold the two or more types of substrates 5 and efficiently lay out the substrates 5 on the printing area of the printer 10.

The number of substrates 5 each holding unit is able to hold may be determined in accordance with the sizes of print regions set on the substrates 5 instead of the sizes of the substrates 5. For example, suppose that first ones of the substrates 5 are larger in size than second ones of the substrates 5, and print regions on the first ones of the substrates 5 are smaller in size than print regions on the second ones of the substrates 5. In this case, the number of first ones of the substrates 5 each associated holding unit is able to hold may be larger than the number of second ones of the substrates 5 each associated holding unit is able to hold.

In the present preferred embodiment, the length of each of the first to third holding units 120A to 120C in the right-left direction is longer than the length of each of the first to third holding units 120A to 120C in the front-rear direction, and the number of substrates 5 each of the first to third holding units 120A to 120C is able to hold in the right-left direction is larger than or at least equal to the number of substrates 5 each of the first to third holding units 120A to 120C is able to hold in the front-rear direction. In one example, each second holding unit 120B is able to hold one second substrate 5B in the front-rear direction and two second substrates 5B in the right-left direction. The right-left direction corresponds to the longitudinal direction of the platen 20. The present preferred embodiment thus enables efficient utilization of space inside the printer 10, making it possible to effectively increase the number of substrates 5 on which the printer 10 is able to effect printing simultaneously.

The operation for making settings for the printing jig 100 or changing settings for the printing jig 100 is preferably performed when each base plate 110 is located at the setting position P2 (see FIG. 2). In the present preferred embodiment, the sliding mechanism 30 supports each base plate 110 such that each base plate 110 is movable at least between the printing position P1, which is the position of each base plate 110 during printing, and the setting position P2 located forward of the printing position P1. The user is thus able to move each base plate 110 to the setting position P2 in holding the substrates 5 in the printing jig 100. Because the setting positions P2 are located forward of the printing positions P1, the user is able to easily perform an operation for holding the substrates 5 in the printing jig 100. In the present preferred embodiment, during printing standby, the carriage 50 of the printing unit 40 is positioned at the home position HP, so that a space above the setting positions P2 is open. Accordingly, the carriage 50 will not make it difficult for the user to perform the operation for making settings for the printing jig 100 or changing settings for the printing jig 100.

Upon ending the operation for holding the substrates 5 in the printing jig 100, the user presses and slides each of the base plates 110 rearward such that each of the base plates 110 is positioned at the printing position P1. Presence of the sliding mechanism 30 and this sliding operation make it possible to easily perform the operation for holding the substrates 5 in the printing jig 100, with each base plate 110 located at the setting position P2, and then slide each base plate 110 so as to position each base plate 110 at the printing position P1.

At this point, the user brings the base plates 110 into abutment with the stoppers 35LF, 35LR, 35RF, and 35RR each provided in an associated one of the movement paths for the base plates 110. This abutment makes it possible to easily position each base plate 110 at the printing position P1. Such stoppers are simple in configuration and thus easily manufacturable and attachable.

In the present preferred embodiment, the sliding mechanism 30 supports the base plates 110 such that each of the base plates 110 is independently movable in the front-rear direction. To be more specific, as illustrated in FIG. 2, the sliding mechanism 30 includes the first sliding mechanism 30L and the second sliding mechanism 30R disposed side by side in the right-left direction, two of the four base plates 110 are fitted to the first sliding mechanism 30L, and the other two of the four base plates 110 are fitted to the second sliding mechanism 30R. Accordingly, two groups of the base plates 110, each including two of the base plates 110 (one of which is fitted to the first sliding mechanism 30L and the other one of which is fitted to the second sliding mechanism 30R), are disposed in alignment with each other in the front-rear direction. Such an arrangement makes it possible to increase the number of substrates 5 on which the printer 10 is able to effect printing simultaneously as a whole while reducing the size and weight of each of the sets, including the base plate 110, so as to facilitate the sliding operation.

Upon start of printing after the substrates 5 have been positioned at the printing positions P1, the recording head 55 discharges ink onto the substrates 5 while moving in the right-left direction. Each time the recording head 55 reciprocates in the right-left direction a predetermined number of times, the gantry 41 moves in the front-rear direction in an intermittent manner. Consequently, images are formed on the substrates 5.

After end of printing, the user slides each of the base plates 110 forward so as to return each of the base plates 110 to the setting position P2. The user then removes the substrates 5 from the holding members by a procedure reverse to that for holding the substrates 5 on the holding members. Alternatively, the substrates 5 may not be removed from the holding members immediately after end of printing, and the procedure may go to an ink drying step while the substrates 5 are still held on the holding members. After the holding units have been removed from the base plates 110, next holding units holding next substrates 5 may be fitted to the base plates 110. This reduces setup time, resulting in an increase in printing productivity. To that end, the number of each type of holding unit is preferably larger than the number of base plates 110.

As described above, the number of each type of holding unit is preferably equal to or larger than the number of base plates 110. In one example, when ratios between the types of substrates 5 are stable and substantially unchanged, the number of each type of holding unit may be smaller than the number of base plates 110. This enables a reduction in the cost of the printing jig 100.

Preferred embodiments and modifications thereof of the present invention have been described thus far. The preferred embodiments and modifications described above, however, are merely illustrative. The techniques disclosed herein may be carried out in various other forms. Some of variations will be described below. In the following description of the variations, components having functions similar to those of the components in the above-described preferred embodiments and modifications are identified by the same reference signs as those used in the above-preferred embodiments, and overlapping description thereof will be omitted or simplified.

Figure 8:
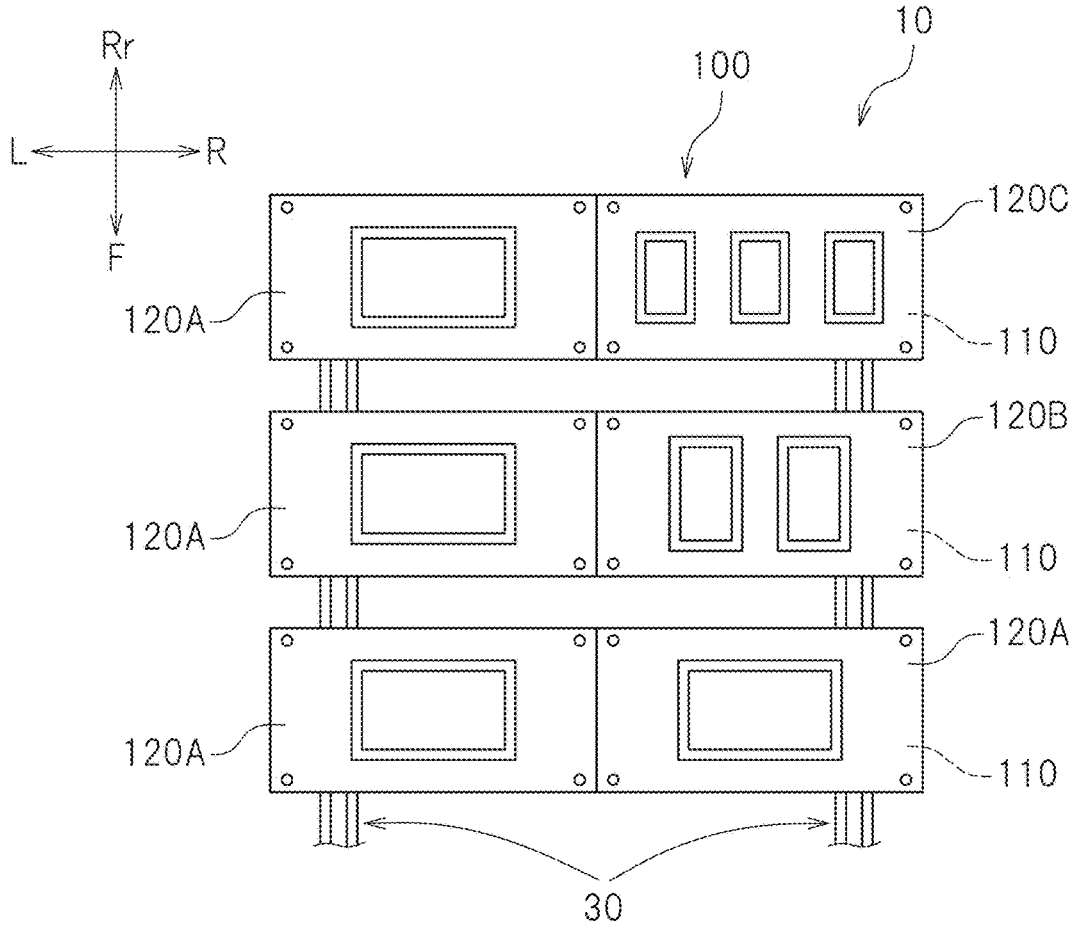
FIG. 8 is a schematic plan view of a printer according to a first variation of a preferred embodiment of the present invention.

In a first variation of a preferred embodiment of the present invention, the number of base plates 110 arranged in the front-rear direction is two or more, and the number of base plates 110 present in the right-left direction is one. FIG. 8 is a schematic plan view of the printer 10 according to the first variation. In the example illustrated in FIG. 8, the printing jig 100 includes three base plates 110 disposed in alignment with each other in the front-rear direction. The sliding mechanism 30 supports the base plates 110 such that each of the base plates 110 is independently movable in the front-rear direction. Such a configuration is advantageous, for example, when the length of the printer 10 in the right-left direction is relatively short.

In the present variation, two or more holding units are attachable to and detachable from each of the base plates 110. FIG. 8 illustrates the example where two holding units are attachable to and detachable from each of the base plates 110. In this variation, two holding units are fitted to each of the base plates 110 such that the two holding units are in alignment with each other in the right-left direction. Two identical holding units (i.e., the first holding units 120A in the example illustrated in FIG. 8), for example, may be fitted to an associated one of the base plates 110 (see, for example, the foremost base plate 110 in FIG. 8). Two holding units fitted to an associated one of the base plates 110 may be different from each other (see, for example, the rearmost base plate 110 and the intermediate base plate 110 in FIG. 8). The holding units to be fitted to the base plates 110 are freely selectable.

The number of base plates 110, the locations of the base plates 110, the number of holding units fittable to each base plate 110, and the locations of the holding units presented in FIG. 8 and the description of the present variation are merely illustrative. In FIG. 8, the holding units are illustrated as being disposed with no interval therebetween on each of the base plates 110. Alternatively, the holding units fitted to each of the base plates 110 may be disposed with a suitable interval therebetween. Unless otherwise specified, the number of base plates 110, the locations of the base plates 110, the number of holding units fittable to each base plate 110, and the locations of the holding units described in a second variation and a third variation are illustrative and do not impose any limitations on these variations.

Figure 9:
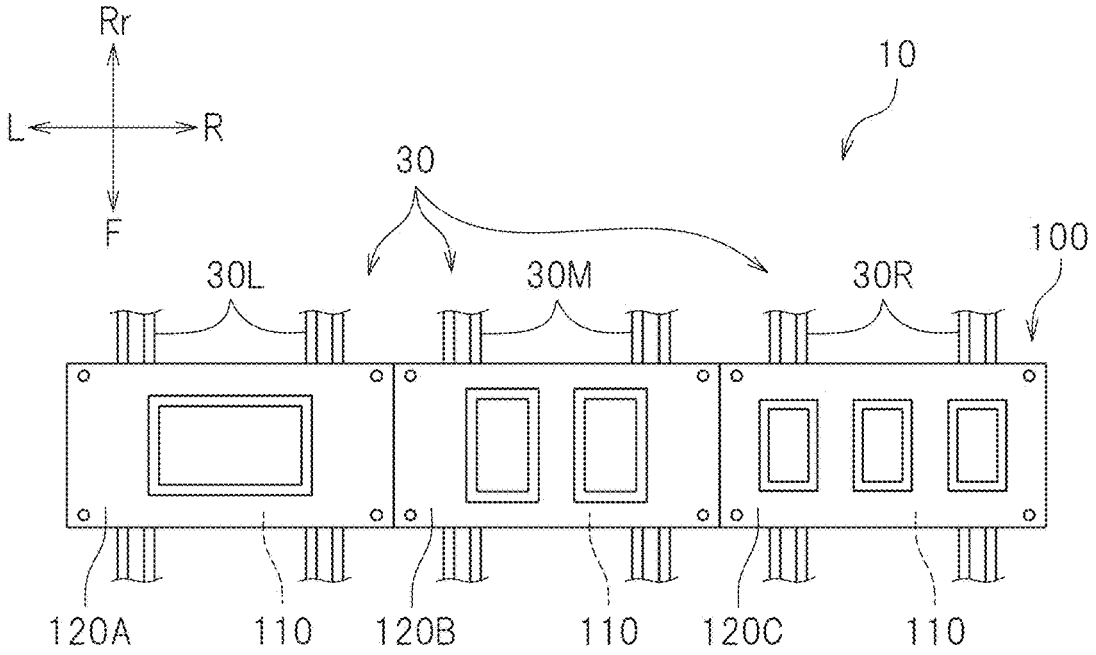
FIG. 9 is a schematic plan view of a printer according to a second variation of a preferred embodiment of the present invention.

In the second variation, the number of base plates 110 arranged in the right-left direction is two or more, and the number of base plates 110 present in the front-rear direction is one. FIG. 9 is a schematic plan view of the printer 10 according to the second variation. In the example illustrated in FIG. 9, the printing jig 100 includes three base plates 110 disposed in alignment with each other in the right-left direction. The sliding mechanism 30 includes: a first sliding mechanism 30L; a second sliding mechanism 30R disposed rightward of the first sliding mechanism 30L; and a third sliding mechanism 30M disposed between the first sliding mechanism 30L and the second sliding mechanism 30R in the right-left direction. In this variation, the first, second, and third sliding mechanisms 30L, 30R, and 30M each support an associated one of the base plates 110 such that the base plates 110 are each movable in the front-rear direction. Such a configuration is advantageous, for example, when the length of the printer 10 in the front-rear direction is relatively short.

In the present variation, one holding unit selected from three types of holding units (i.e., the holding units 120A, 120B, and 120C) is attachable to and detachable from each of the base plates 110. Alternatively, two or more holding units may be attachable to and detachable from each of the base plates 110. In this case, the locations of the holding units on each of the base plates 110 are not limited to any particular locations. The holding units may be disposed in alignment with each other in the right-left direction or the front-rear direction on each of the base plates 110, or may be disposed in a matrix arrangement in the right-left direction and the front-rear direction on each of the base plates 110.

Figure 10:
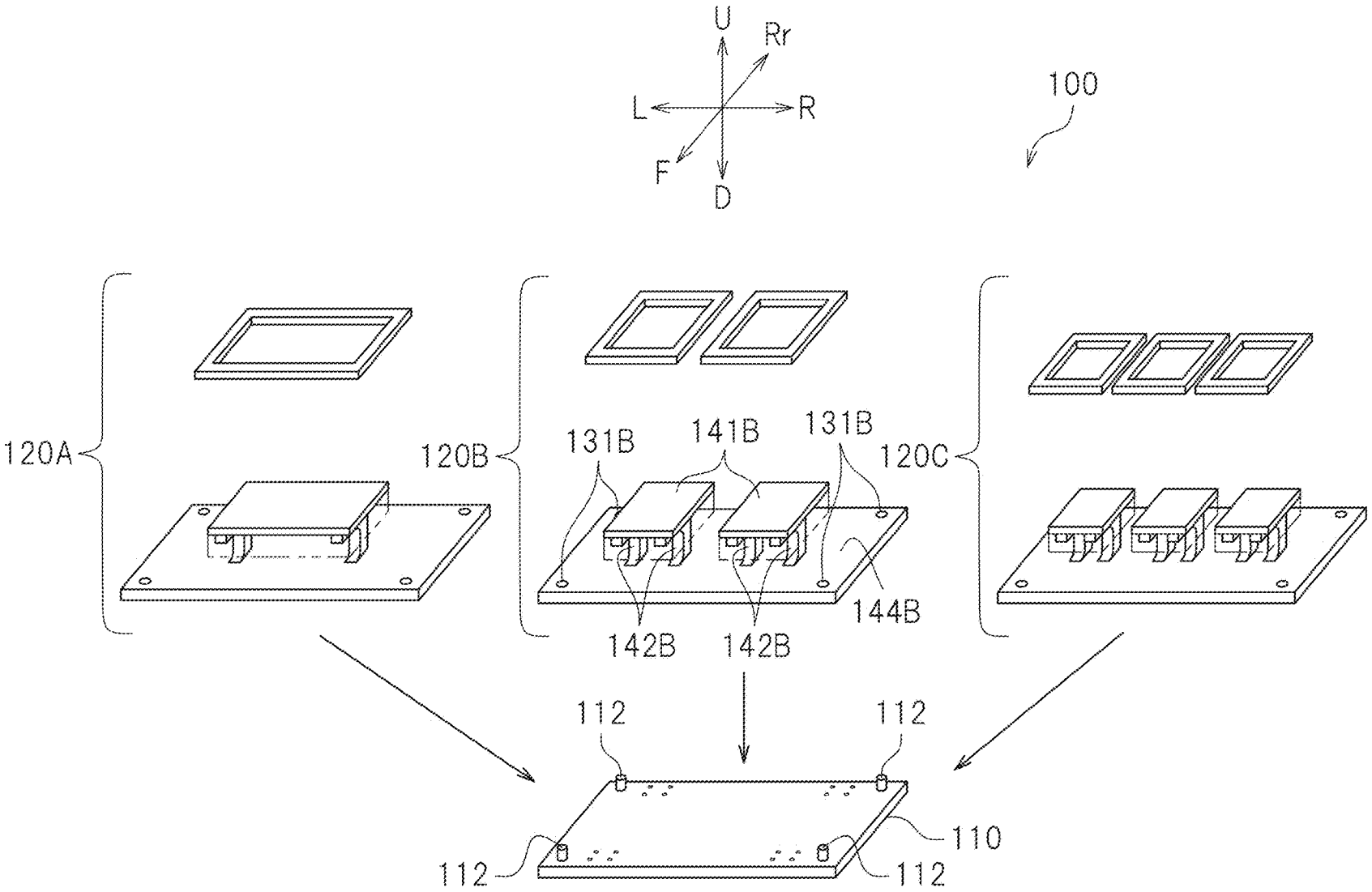
FIG. 10 is a schematic diagram illustrating a structure of a printing jig according to a third variation of a preferred embodiment of the present invention.

In the third variation, the printing jig 100 includes holding units each including holding member(s) and a docking member integral with each other. FIG. 10 is a schematic diagram illustrating a structure of the printing jig 100 according to the third variation. FIG. 10 illustrates only components provided in connection with one base plate 110. Similarly to FIGS. 3 to 6, FIG. 10 illustrates the components of the printing jig 100 exploded in the up-down direction.

The base plate 110 according to the present variation may be similar to the base plate 110 according to the foregoing preferred embodiments. As illustrated in FIG. 10, the second holding unit 120B according to the present variation, for example, is substantially identical in shape to a combination of the second holding members 140B and the second docking member 130B according to the foregoing preferred embodiments. The second holding unit 120B may be fabricated by connecting two or more components by, for example, welding and/or screwing. In this variation, the second holding unit 120B includes a flat plate seat 144B, two second supports 141B, and two pairs of second legs 142B. The flat plate seat 144B includes four pin holes 131B into which the four positioning pins 112 of the base plate 110 are to be inserted. In the present variation, the seat 144B is directly fitted to the base plate 110. The two second supports 141B are each located above the seat 144B. The two pairs of second legs 142B each extend upward from the seat 144B and each support an associated one of the two second supports 141B. As illustrated in FIG. 10, the first holding unit 120A and the third holding unit 120C are similar in configuration to the second holding unit 120B except for the number of holding frames, the locations of the holding frames, the number of supports, the locations of the supports, the number of legs, and the locations of the legs.

As described above, the holding units do not necessarily have to be configured such that each holding unit is separable into holding member(s) and a docking member. The holding units are not limited to any particular shapes. In one example, each holding unit may be reduced in weight by removing portion(s) of material(s) from the shape illustrated in FIG. 10. In another example, a portion of each holding unit corresponding to a docking member may not be formed into a flat plate shape but may be formed by a combination of columnar components. The shape of each leg is not limited to any particular shape. The number of legs is not limited to any particular number. The present variation may be combined with not only the foregoing preferred embodiments but also, for example, the first variation or the second variation.

Techniques disclosed herein other than those mentioned in the above-described preferred embodiments, modifications and variations may be carried out in various forms. In the above-described preferred embodiments and modifications, for example, the base plates 110 are supported by the sliding mechanism 30 such that the base plates 110 are slidable in the front-rear direction. The base plates, however, do not necessarily have to be slidably supported. In one example, the base plates may be directly placed at print positions on the platen or flat bed.

In the above-described preferred embodiments and modifications, the supports for the substrates 5 are lifted above the base plates 110 by the legs. Alternatively, the supports for the substrates 5 may be located at substantially the same height as the base plates. The printer may be configured such that a printing jig supporting component, such as a flat bed, moves in the up-down direction.

The components of the printing jig do not necessarily have to be configured such that the components are combined in the up-down direction. In one example, the components of the printing jig may be configured such that a first one of the components may be combined with a second one of the components by sliding the first one of the components in the front-rear direction, the right-left direction, or any other direction with respect to the second one of the components. A method for effecting positioning of the components is not limited to any particular method. A method for holding the substrates is not limited to the method according to the above-described preferred embodiments and modifications.

The number of substrates on which the printer is able to effect printing simultaneously for each set (which is provided by fitting a holding unit to a base plate) is preferably determined such that the number of substrates each having a small size or a small print region is larger than the number of substrates each having a large size or a large print region. The number of substrates on which the printer is able to effect printing simultaneously for each set, however, may be determined such that the number of substrates each having a small size or a small print region is equal to the number of substrates each having a large size or a large print region. Depending on the circumstances, the number of substrates each of which has a small size or a small print region and on which the printer is able to effect printing simultaneously may be smaller than the number of substrates each of which has a large size or a large print region and on which the printer is able to effect printing simultaneously.

In the above-described preferred embodiments and modifications, each holding unit is configured such that the number of substrates 5 each holding unit is able to hold in the longitudinal direction of the platen 20 is equal to or larger than the number of substrates 5 each holding unit is able to hold in the width direction of the platen 20. When the substrates have, for example, long and narrow print regions, however, the number of substrates each holding unit is able to hold in the longitudinal direction of the platen may be smaller than the number of substrates each holding unit is able to hold in the width direction of the platen.

In the above-preferred embodiments and modifications, each holding member is fitted to an associated one of the base plates 110 through an associated one of the docking members. Alternatively, one or more holding members may be directly fitted to each base plate. In this case, the holding member(s) is/are equivalent to the holding unit(s). The fitted portion of each base plate to which one or more holding members are positioned and fitted may be, for example, one or more recesses or one or more groups of positioning pins. The fitted portion of each base plate and the fitting portion of each holding member are not limited to any particular configuration. The base plates may be configured to directly support the substrates. This eliminates the need for the docking members and the holding members, resulting in a reduction in the number of components of the printing jig.

Unless otherwise stated, the printer is not limited to any particular structure, configuration, or arrangement. The techniques disclosed herein are applicable to, for example, small size printers of a flatbed type. Preferred embodiments of the present invention are not limited to any particular printing method. For inkjet printers, examples of ink to be used may include water-based ink, solvent ink, and photo-curable ink.

The terms and expressions used herein are for description only and are not to be interpreted in a limited sense. These terms and expressions should be recognized as not excluding any equivalents to the elements shown and described herein and as allowing any modification encompassed in the scope of the claims. The present invention may be embodied in many various forms. This disclosure should be regarded as providing preferred embodiments of the principles of the present invention. These preferred embodiments are provided with the understanding that they are not intended to limit the present invention to the preferred embodiments described in the specification and/or shown in the drawings. The present invention is not limited to the preferred embodiments described herein. The present invention encompasses any of preferred embodiments including equivalent elements, modifications, deletions, combinations, improvements and/or alterations which can be recognized by a person of ordinary skill in the art based on the disclosure. The elements of each claim should be interpreted broadly based on the terms used in the claim, and should not be limited to any of the preferred embodiments described in this specification or referred to during the prosecution of the present application.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A printing jig comprising:

bases to be fitted to a printing apparatus;

a first holder configured able to hold one or more first substrates and fittable to each of the bases; and a second holder able to hold one or more second substrates different in size from the first substrate or substrates and fittable to each of the bases; wherein the first holder includes a first fitting portion to be fitted to each of the bases;

the second holder includes a second fitting portion to be fitted to each of the bases;

each of the bases is structured such that the first fitting portion and the second fitting portion are both fittable thereto;

the first holder includes:

a first docking plate including the first fitting portion; and one or more first substrate holders to be fittable to and detachable from the first docking plate to hold the first substrate or substrates;

the second holder includes:

a second docking plate including the second fitting portion; and one or more second substrate holders to be fittable to and detachable from the second docking plate to hold the second substrate or substrates.

2. The printing jig according to claim 1, wherein the first holder is able to hold a first quantity of the first substrates; and the second holder is able to hold a second quantity of the second substrates, the second quantity being different from the first quantity.

3. The printing jig according to claim 1, wherein the first docking plate is fitted to each of the bases so as to be overlaid on the base, the first docking plate including one or more first recesses defined in an upper surface of the first docking plate, with the first docking plate fitted to the base; and the one or more first substrate holders are fitted to the one or more first recesses.

4. The printing jig according to claim 2, wherein the second substrate or substrates are smaller in size than the first substrate or substrates; and the second quantity is larger than the first quantity.

5. A printing apparatus comprising:

a support table extending in a front-rear direction and a right-left direction;

a recording head disposed above the support table; and a slider to which a printing jig is fitted and supporting the printing jig such that the printing jig is movable in the front-rear direction above the support table; wherein the printing jig comprises:

bases to be fitted to a printing apparatus;

a first holder configured able to hold one or more first substrates and fittable to each of the bases; and a second holder able to hold one or more second substrates different in size from the first substrate or substrates and fittable to each of the bases;

the first holder includes a first fitting portion to be fitted to each of the bases;

the second holder includes a second fitting portion to be fitted to each of the bases;

each of the bases is structured such that the first fitting portion and the second fitting portion are both fittable thereto; and the slider supports the bases such that each of the bases is movable at least between a first position and a second position, the first position being a position of each of the bases during printing, the second position being located forward of the first position.

6. The printing jig according to claim 1, wherein the first holder includes:

a support to support the first substrate; and a leg supporting the support from below; and the first substrate includes a flexible sheet or overlaid flexible sheet materials and is larger than the support in a plan view.

7. The printing apparatus according to claim 5, wherein a length of each of the bases in a longitudinal direction of the support table is longer than a length of each of the bases in a width direction of the support table;

a length of the first holder in the longitudinal direction of the support table is longer than a length of the first holder in the width direction of the support table, and a number of the first substrates that the first holder is able to hold in the longitudinal direction of the support table is two or more.

8. The printing apparatus according to claim 5, wherein the slider supports the bases such that each of the bases is independently movable in the front-rear direction.

9. The printing apparatus according to claim 8, further comprising stoppers each disposed in an associated one of movement paths for the bases to effect positioning of an associated one of the bases at the first position by being brought into abutment with the associated base.

10. The printing apparatus according to claim 8, wherein at least two of the bases are fitted to the slider so as to be in alignment with each other in the front-rear direction.

11. The printing apparatus according to claim 8, wherein the slider includes a first slider and a second slider disposed side by side in the right-left direction;

at least one of the bases is fitted to the first slider; and at least another one of the bases is fitted to the second slider.

12. A printing jig comprising:

bases to be fitted to a printing apparatus;

a first holder configured able to hold one or more first substrates and fittable to each of the bases; and a second holder able to hold one or more second substrates different in size from the first substrate or substrates and fittable to each of the bases; wherein the first holder includes a first fitting portion to be fitted to each of the bases;

the second holder includes a second fitting portion to be fitted to each of the bases;

each of the bases is structured such that the first fitting portion and the second fitting portion are both fittable thereto;

the first holder includes:

a first docking plate including the first fitting portion; and one or more first substrate holders to be fitted to the first docking plate to hold the first substrate or substrates;

the second holder includes:

a second docking plate including the second fitting portion; and one or more second substrate holders to be fitted to the second docking plate to hold the second substrate or substrates;

the second docking plate is different from the first docking plate; and the second substrate holders are different from the first substrate holders.

13. The printing jig according to claim 12, wherein the first docking plate is fitted to each of the bases so as to be overlaid on the base, the first docking plate including one or more first recesses defined in an upper surface of the first docking plate, with the first docking plate fitted to the base; and the one or more first substrate holders are fitted to the one or more first recesses.

14. The printing jig according to claim 12, wherein the first holder is able to hold a first quantity of the first substrates; and the second holder is able to hold a second quantity of the second substrates, the second quantity being different from the first quantity.

15. The printing jig according to claim 14, wherein the second substrate or substrates are smaller in size than the first substrate or substrates; and the second quantity is larger than the first quantity.

16. The printing jig according to claim 12, wherein the first holder includes:

a support to support the first substrate; and a leg supporting the support from below; and the first substrate includes a flexible sheet or overlaid flexible sheet materials and is larger than the support in a plan view.

* * * * *